US011519109B2

(12) United States Patent
Resneck et al.

(10) Patent No.: US 11,519,109 B2
(45) Date of Patent: Dec. 6, 2022

(54) SYSTEM AND METHOD FOR MANUFACTURING CUSTOM-SIZED GARMENTS

(71) Applicant: Bolt Threads Inc., Emeryville, CA (US)

(72) Inventors: Myrrhia Rae Resneck, San Francisco, CA (US); Mitchell Joseph Heinrich, Oakland, CA (US)

(73) Assignee: BOLT THREADS, INC., Emeryville, CA (US)

( * ) Notice: Subject to any disclaimer, the term of this patent is extended or adjusted under 35 U.S.C. 154(b) by 193 days.

(21) Appl. No.: 16/983,247

(22) Filed: Aug. 3, 2020

(65) Prior Publication Data

US 2021/0017681 A1 Jan. 21, 2021

Related U.S. Application Data

(63) Continuation of application No. 16/043,252, filed on Jul. 24, 2018, now Pat. No. 10,787,756.

(51) Int. Cl.

| | |
|---|---|
| ***D04B 15/70*** | (2006.01) |
| ***D04B 15/36*** | (2006.01) |
| ***D04B 7/32*** | (2006.01) |

(52) U.S. Cl.

CPC ..... *D04B 15/70* (2013.01); *D04B 7/32* (2013.01); *D04B 15/365* (2013.01)

(58) Field of Classification Search

CPC ..... D04B 15/70; D04B 7/32; D04B 15/365; D04B 37/02; G05B 19/40931; G05B 19/40932; G05B 2219/45194

USPC ..... 700/141

See application file for complete search history.

(56) References Cited

U.S. PATENT DOCUMENTS

| | | | | |
|---|---|---|---|---|
| 4,070,874 | A | 1/1978 | Zouhar et al. | |
| 4,608,642 | A | 8/1986 | Shima | |
| 5,719,777 | A | 2/1998 | Kotaki | |
| 6,105,520 | A * | 8/2000 | Frazer | D05B 19/00 112/475.08 |
| 6,338,002 | B1 | 1/2002 | Kuo | |
| 6,415,199 | B1 | 7/2002 | Liebermann | |
| 6,611,730 | B1 | 8/2003 | Stoll et al. | |
| 6,880,367 | B2 | 4/2005 | Suzuki | |
| 7,127,321 | B2 | 10/2006 | Kenji et al. | |
| 7,289,870 | B2 | 10/2007 | Manabu | |
| 7,386,360 | B2 | 6/2008 | Noriyuki | |
| 7,493,245 | B2 | 2/2009 | Suzuki | |
| 7,664,564 | B2 | 2/2010 | Kawasaki et al. | |
| 7,738,990 | B2 | 6/2010 | Furukawa et al. | |
| 8,135,489 | B2 | 3/2012 | Terai et al. | |
| 8,506,303 | B1 | 8/2013 | Smith et al. | |

(Continued)

*Primary Examiner* — Danny Worrell

(74) *Attorney, Agent, or Firm* — Marshall, Gerstein & Borun LLP

(57) ABSTRACT

A method for manufacturing a garment includes gathering customer data from a plurality of customers, the customer data being associated with respective ones of a plurality of garment orders and including customer information regarding at least one customizable garment parameter and generating a schedule for producing a plurality of customized garments including analyzing the at least one customizable garment parameter for the at least some of the plurality of garment orders. The method further includes manufacturing the plurality of customized garments according to the schedule.

17 Claims, 11 Drawing Sheets

(56) References Cited

U.S. PATENT DOCUMENTS

| | | | |
|---|---|---|---|
| 8,657,603 | B2 | 2/2014 | Solomon |
| 10,351,982 | B2 | 7/2019 | deGuzman |
| 2004/0078285 | A1 | 4/2004 | Bijvoet |
| 2005/0049741 | A1 | 3/2005 | Dias et al. |
| 2007/0156277 | A1 | 7/2007 | Suzuki |
| 2007/0198120 | A1 | 8/2007 | Wannier et al. |
| 2008/0147231 | A1 | 6/2008 | Fernandez |
| 2009/0082898 | A1 | 3/2009 | Terai et al. |
| 2009/0222127 | A1 | 9/2009 | Lind |
| 2010/0145495 | A1 | 6/2010 | Terai |
| 2020/0032434 | A1 | 1/2020 | Resneck et al. |

* cited by examiner 112
114
116
118
120
122
124
130
132
134
L2
116(Pb+2)
116(Pf)
116(Pb)
116(Pb+1)
116(Pf+1)
114d

SYSTEM AND METHOD FOR MANUFACTURING CUSTOM-SIZED GARMENTS

CROSS REFERENCE TO RELATED APPLICATION

The present application is a Continuation of U.S. patent application Ser. No. 16/043,252, filed on Jul. 24, 2018, now U.S. Pat. No. 10,787,756, entitled "CUSTOM SIZING AND METHODS FOR A KNITTED GARMENT HAVING RADIAL SYMMETRY," the entire contents of which are incorporated herein by reference in its entirety.

BACKGROUND OF THE INVENTION

Techniques have been developed and implemented to facilitate the creation of so-called "seamless" garments using various types of automated knitting machines. In these techniques, the need to create separate parts of a garment separately and assemble them together (by additional manual stitching, for example) or to impart a three-dimensional shape on a garment (i.e. a tubular form having overlapping sections) by stitching edges of a flat component together, may be significantly reduced or, for certain garments, eliminated altogether, resulting in the characteristic seamless nature of the garment through at least significant portions of the garment. Various types of automated knitting machines can be used to implement the developed seamless knitting techniques. In some aspects, tubular weft knitting machines have been developed to knit seamless tubes of knitted material. Such machines, however, offer reduced flexibility in stitch types and sizing within a single run of knitted material.

Flat-bed weft knitting equipment can be run according to certain specific techniques to achieve seamless material or garments with some of the characteristic flexibility such machines provide. To that end, in the use of a two-bed weft knitting machine (which may also be referred to as a V-bed knitting machine due to the relative orientation of the beds), one bed is used for one of two overlapping sections of the garment (e.g., the front of a sweater body, sleeve, etc.) and the other bed is used for the other section (e.g., the back) with the stitches on the outermost needles on which stitches are applied being linked from the front bed to the back bed to produce the two sections of the garment already attached together. To maintain the ability to transfer stitches, however, the stitches are applied to the needles in an alternating manner with the needles including stitches being staggered from the front bed to the back bed. As can be appreciated, specific sequences for moving stitches among needles 116 in such an arrangement are required. Additionally, three bed knitting machines have been developed with a central bed disposed between the front and back beds to solely handle transferring for both beds. Such machines, however, also exhibit drawbacks, including cost, the need to replace existing equipment, and complexity. Accordingly, further advancement in seamless knitting techniques may be needed to expand the range of garments and characteristics that can be achieved by way of seamless knitting on a V-bed flat weft knitting machine.

Additionally, the use of seamless garment production techniques and the ways in which the instructions for automated knitting machines are produced offer opportunities to make the garments produced customizable along a number of different parameters. Accordingly, advancements in the ways in which such customization is made available and implemented may also be useful. Still further, developments to provide such customization at scale may also be useful.

SUMMARY OF THE INVENTION

According to one aspect of the present disclosure, a method for manufacturing a knitted garment includes obtaining customer data regarding at least one customizable garment parameter, and applying at least one sequencing module to the customer data to generate a pattern for a customized garment according to the at least one customizable garment parameter. The at least one sequencing module includes a radial symmetry module that includes a sequence that includes transferring stitches on respective needles in a first section from a first needle bed to a second needle bed and transferring stitches on respective needles in a second section from the second needle bed to the first needle bed. The first and second section stitches are divided about a center location and are disposed on corresponding first and second sides thereof. A first transfer sequence is applied to the first section of stitches including executing an underlapping transfer of stitches from successive pairs of needles in the second bed to successive single needles in the first bed, respectively. A second transfer sequence is applied to the second section of stitches including executing an overlapping transfer of stitches from successive pairs of needles in the second bed to successive single needles in the first bed, respectively.

In one aspect, the first underlapping transfer may include changing a racking position of the second bed to align a fourth un-transferred stitch on the first side with a second open needle on the first side, transferring the fourth un-transferred stitch and a third un-transferred stitch to the second open needle and a first open needle. The sequence may further include changing the racking position of the second bed to align a second un-transferred stitch with the second open needle, and transferring the second un-transferred stitch and a first un-transferred stitch to the second open needle and the first open needle, respectively.

In a further aspect, the second overlapping transfer may include transferring a second un-transferred stitch and a first un-transferred stitch on the second side to a second open needle and a first open needle on the second side, respectively, changing a racking position of the second bed to align a fourth un-transferred stitch with the second open needle, and transferring the fourth un-transferred stitch and a third un-transferred stitch to the second open needle and the first open needle, respectively. The second transfer sequence may further include changing the racking position of the second bed to align a sixth un-transferred stitch with the second open needle, and transferring the sixth un-transferred stitch and a fifth un-transferred stitch to the second open needle and the first open needle, respectively.

In a further aspect of the method, the customer data is of first a customer, and the method may further include gathering customer data from a plurality of customers, the customer data being taken over internet and is associated with respective ones of a plurality of knitted garment orders. In this aspect, the method may also include generating patterns for a plurality of customized garments according to at least some of the plurality of knitted garment orders, including applying the at least one sequencing module to the customer data associated with each of the plurality of knitted garment orders according to the at least one customizable garment parameter associated with each of the plurality of knitted garment orders, generating a schedule for producing the plurality of customized garments including analyzing the at least one customizable garment parameter for the plurality of knitted garment orders, and manufacturing the plurality of customized garments according to the schedule.

In another aspect of the disclosure, a method for making a knitted garment with a reduction section exhibiting radial symmetry includes executing an automated knitting pattern on a knitting machine having a first needle bed and a second needle bed. The knitting pattern includes transferring stitches in a first section from respective needles in a first needle bed to corresponding needles in a second bed and transferring stitches in a second section from respective needles in the second needle bed to corresponding needles in the first bed. The first and second section stitches are divided about a center location and are disposed on corresponding first and second sides thereof. A first transfer sequence is applied to the first section of stitches including executing an underlapping transfer of stitches from successive pairs of needles in the second bed to successive single needles in the first bed, respectively. A second transfer sequence is applied to the second section of stitches including executing an overlapping transfer of stitches from successive pairs of needles in the second bed to successive single needles in the first bed, respectively.

In yet another aspect of the disclosure, a system for manufacturing a plurality of knitted garments includes a pattern generation module that obtains data regarding at least one customizable garment parameter respectively associated with the plurality of knitted garments and applies at least one sequencing module to the customer data to generate respective patterns for the plurality of knitted garments according to the at least one customizable garment parameter, including radial symmetry module. The radial symmetry module includes transferring stitches from a front needle bed and a back needle bed including executing an underlapping transfer of stitches from successive pairs of needles in the second bed to successive single needles in the first bed, respectively, and transferring stitches from the front needle bed and the back needle bed including executing an overlapping transfer of stitches from successive pairs of needles in the second bed to successive single needles in the first bed, respectively. The system further includes a scheduling module generating a schedule for producing the plurality of knitted garments including analyzing the at least one customizable garment parameter for the plurality of knitted garment orders and automated production equipment producing the plurality of knitted garments according to the schedule using the respective patterns.

In yet another aspect of the disclosure, a method for manufacturing a garment includes gathering customer data from a plurality of customers over the internet, the customer data being associated with respective ones of a plurality of garment orders and including customer data of first a customer regarding at least one customizable garment parameter. The method further includes applying at least one sequencing module to the customer data to generate a pattern for a customized garment according to the at least one customizable garment parameter, generating patterns for a plurality of garments according to at least some of the plurality of garment orders, including applying the at least one sequencing module to the customer data associated with each of the plurality of garment orders according to the at least one customizable garment parameter associated with each of the plurality of garment orders, generating a schedule for producing the plurality of customized garments including analyzing the at least one customizable garment parameter for the plurality of garment orders, and manufacturing the plurality of garments according to the schedule.

These and other features, advantages, and objects of the present invention will be further understood and appreciated by those skilled in the art by reference to the following specification, claims, and appended drawings.

DETAILED DESCRIPTION

Figure 1:
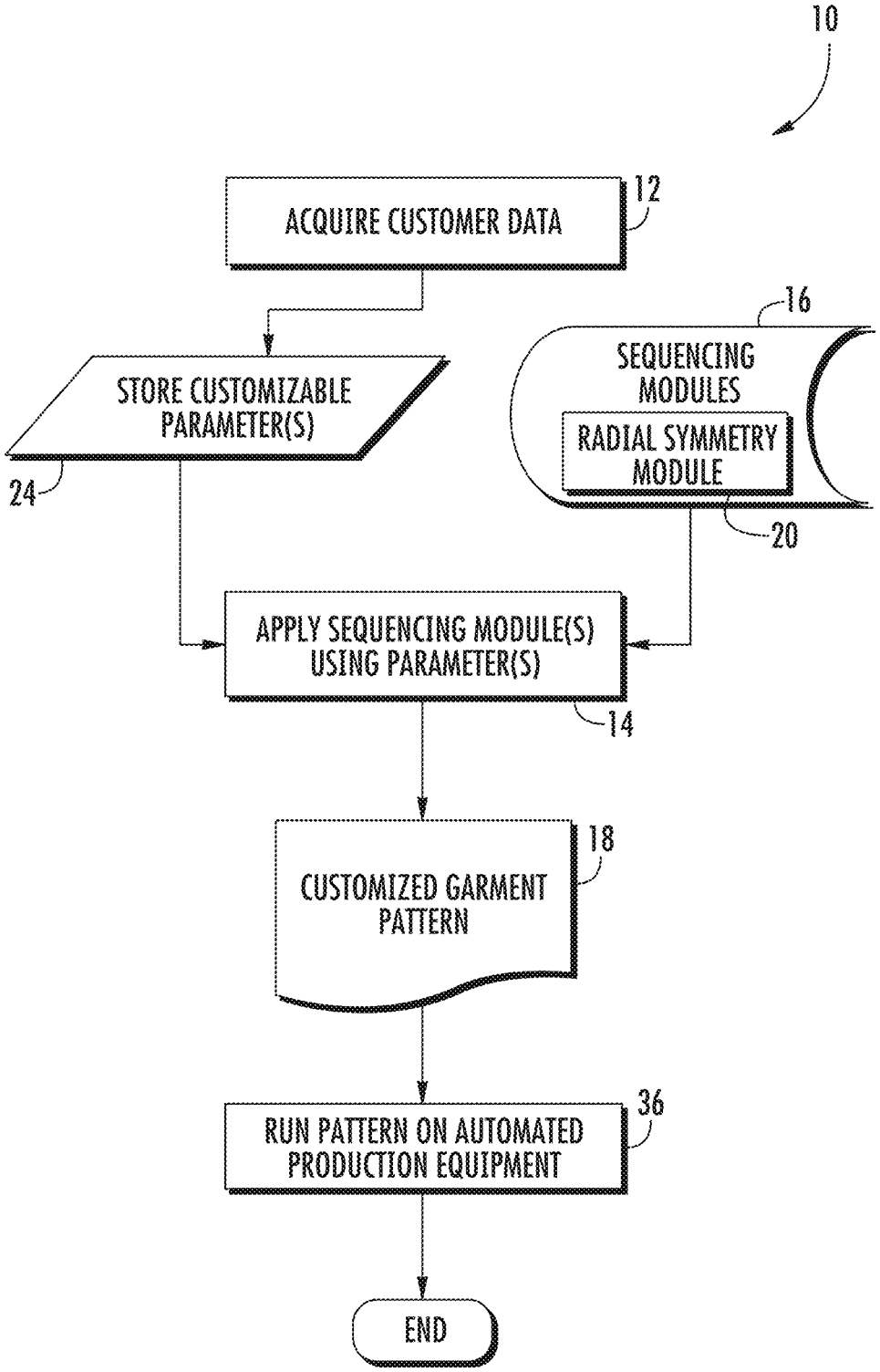
FIG. 1 is a flowchart depicting general steps in producing a pattern for a customized knitted garment including applying at least one module including a radial symmetry module.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1-4, a method 10 for manufacturing a customized garment (e.g., garment 110, shown in FIG. 7) includes obtaining 12 customer data 24 regarding at least one customizable garment parameter. The method 10 further includes applying 14 at least one sequencing module to the customer data 24 to generate a pattern 18 for the customized garment 110 according to the at least one customizable garment parameter. The at least one sequencing module includes a radial symmetry module 20 that includes a sequence 22 (depicted schematically in FIG. 2) having steps of positioning 26 a first section 112 of stitches 114 (as shown in FIGS. 5A-6F) on respective needles 116 in a first needle bed 118 and positioning 28 a second section 120 of stitches 114 on respective needles 116 in a second needle bed 122. The first and second sections 112,120 of stitches 114 are divided 30 about a generally central location 124 and are disposed on corresponding first and second sides 126 and 128 thereof. The sequence 22 of the radial symmetry module 20 further includes applying a first transfer sequence 32 (depicted schematically in greater detail in FIG. 3) to the first section 112 of stitches 114 including executing an underlapping transfer 50*a*,50*b* of stitches 114 from successive pairs of needles 116 in the second bed 122 to successive single needles 116 in the first needle bed 118 and applying a second transfer sequence 34 (depicted schematically in greater detail in FIG. 4) to the second section 120 of stitches 114 including executing an overlapping transfer 70*a*,70*b* of stitches 114 from successive pairs of needles 116 in the second bed 122 to successive single needles 116 in the first bed 118, respectively.

As can be appreciated from the present disclosure, the above-describe radial symmetry module 20 is useable in the overall method 10 to produce a portion of the pattern 18 that corresponds to a portion of the garment 110 to-be produced. In this respect, the pattern 18 can represent instructions executed 32 on automated production equipment 130 to produce the subject garment 110. In particular, the equipment 130 is an automated knitting machine, relevant portions of which are illustrated schematically in FIGS. 5A-6F, and the pattern 18 corresponds with known conventions for instructing the knitting machine 130 to carry out functions understood to be within the general capability of the machine, which may include a particular type, configuration, and/or model of automated knitting machines. To that end, the pattern 18 may be machine-readable data that can be generated on a computer or other electronic device having the radial sequencing module 20, along with other sequencing modules (discussed further below) stored in memory accessible thereby, as well as the programming or operability to assemble and adapt the modules to at least the customizable parameter data 24 acquired in step 12. Such a pattern 18 may not be readable or generally discernable to a human, but may be readable or displayable in user-readable format by the computer itself or another suitably-equipped electronic device.

In general, the automated production equipment described herein as an automated knitting machine 130 includes a plurality of needles 116 (depicted schematically in FIGS. 5A-6F) of a known configuration adapted for retaining loops of a continuous strand of filament material (for example, yarn or thread), such loops being generally referred to as stitches 114. The knitting machine further includes a carriage configured for selectively moving the needles, building new rows of stitches that are vertically interlocked with the existing stitches, and transferring the stitches between adjacent needles in order to stack more than one stitch on a needle. In particular, the radial symmetry module 20 described herein is adapted for use on a flat, V-bed weft knitting machine having two rows of needles 116 (which may in various examples each include hundreds of needles) carried in the respective first and second beds 118 and 122 discussed above. In general, the beds of such a type of machine are referred to as a front bed, which, in one implementation, may correspond with the above-referenced first bed 118, and a back bed, which in such implementation may correspond with the back bed 122. The beds 118,122 are angled with respect to each other (i.e. in a V-shaped arrangement) with the needles 116 positioned to extend outwardly from the apex of the V-shape to cross each other, as controlled by passing of the carriage in a particular manner. In this respect, the needles (which are typically of a latch-type configuration known in the art) may be selectively actuated in a particular manner to transfer an associated stitch (or stitches) from a corresponding needle 116 in one of the first bed 118 or the second bed 122 to a corresponding needle 116 appropriately aligned therewith in the other bed 122,118.

To provide the ability to transfer stitches 114 to needles 116 that are not originally aligned, one or both of the needle beds 118,122 can be moved laterally to change the alignment between needles 116 in what is generally referred to as racking (including by a number of corresponding with the number of needle positions by which the particular rack is moved). When done between successive stitching operations (i.e., the application of a new set of stitches, which replaces a previous set of stitches) by the carriage, the transfer of stitches between and among the needles 116 can result in particular stitching effects that can be repeated in a controlled manner to give a desired effect to the article or relevant portion thereof being manufactured, according to concepts generally understood in the art.

In a further aspect, techniques have been developed and implemented to facilitate the creation of garments in a generally "seamless" manner using a flat-bed weft knitting machine, including a two-bed arrangement as described above. In these techniques, the need to create separate parts of a garment separately and assemble them together (by additional manual stitching, for example) or to impart a three-dimensional shape on a garment (i.e. a tubular form) by sewing edges of a flat component together, may be significantly reduced or, for certain garments, eliminated altogether. These techniques largely involve the use of one bed 118 or 122 for the "front" of a garment (e.g., sweater body, sleeve, etc.) and the other bed 122 or 118 for the "back" of the garment with the stitches on the outermost needles 116 on which stitches are applied 114 being linked from the front bed 118 to the back bed 122 to produce the garment with the front and back already attached together, including separate portions, such as the body and sleeves already assembled front-to-back and with the other adjacent portions. To maintain the ability to transfer stitches 114, however, the stitches are applied to the needles 116 in an alternating manner with the needles 116 including stitches 114 being staggered from the front bed 118 to the back bed 122. As can be appreciated, specific sequences for transferring stitches among needles 116 in such an arrangement are required.

The radial symmetry module 20, described generally above, involves a sequence of stitch 114 transfers among specific needles 116 in a knitting machine of the above-described V-bed flat weft knitting machine executed between stitching operations to produce a portion of the subject garment 110 that exhibits radial symmetry (as discussed further below). In particular, the radial symmetry module 20 is configured to be incorporated into the manufacture of the subject garment 110 according to a seamless knitting operation, in which alternating needles 116 on the first and second beds 118,122 include stitches 114 resulting from a previous stitching operation. An arrangement of stitches 114 is shown schematically on needles 116 in the first and second beds 118,122 depicted schematically in FIG. 5A. Accordingly, the sequence 22 initially involves transferring stitches between the beds 118,122 such that all of the stitches in the respective first and second sections 112,120 are on the same bed. In particular, all of the stitches 114 in the first section 112 that are initially on the back bed 122 are transferred 32 to the front bed 118, and all of the stitches 114 in the second section 120 that are initially on the front bed 118 are transferred 34 to the back bed 122. This operation allows the aforementioned first and second transfer sequences 32 and 34 to be carried out, as described in greater detail below, on pairs of adjacent stitches 114 corresponding with the front portion of the subject garment 110 and the back portion (as generally defined by the respective bed 118, 122 on which they are formed, not necessarily the ultimate composition of the garment) to carry out the same transfer operation thereon simultaneously.

Subsequently, the respective stitches 114 are transferred 38 back to the originating bed 118,122. As can be seen in FIG. 6F (discussed further below), the completion of the first and second transfer sequences 32,34 results in all stitches 114 being positioned on the front bed 118. Accordingly, the stitches 114 are transferred 38 from the respective needles 116 in the front bed 118 to the corresponding needles 116 in the back bed 122 in an alternating manner, which results in the respective front and back portions being separated back into their respective beds (albeit with the doubled arrangement achieved by the transfer sequences 32 and 34, respectively), as shown in FIG. 6F. This allows a subsequent knitting operation 44 to be carried out on the doubled stitches 114*d* to result in a new set of single stitches 114 respectively interlaced with the doubled stitches 114*d* from the transfer sequences 32,34. The process can then be carried out again with the newly formed single stitches 114 as the stitches subjected to the step of being divided 30 into first and second sets, with a center point 124 defined therebetween, transferred 26,28 to the respective bed 118,122, subjected to the respective first and second transfer sequences 32,34, being returned 42 to the respective first and second needle beds 118,122 prior to additional stitching 44. In various implementations, the stitching 44 can include applying multiple rows of single stitches 114 between iterations of the transfer sequences 32,34 to provide different characteristics for the portion of the pattern 18 produced by the radial symmetry module 20, some of such characteristics being customizable or relating to customizable characteristics 24 of the subject garment 110.

Figure 2:
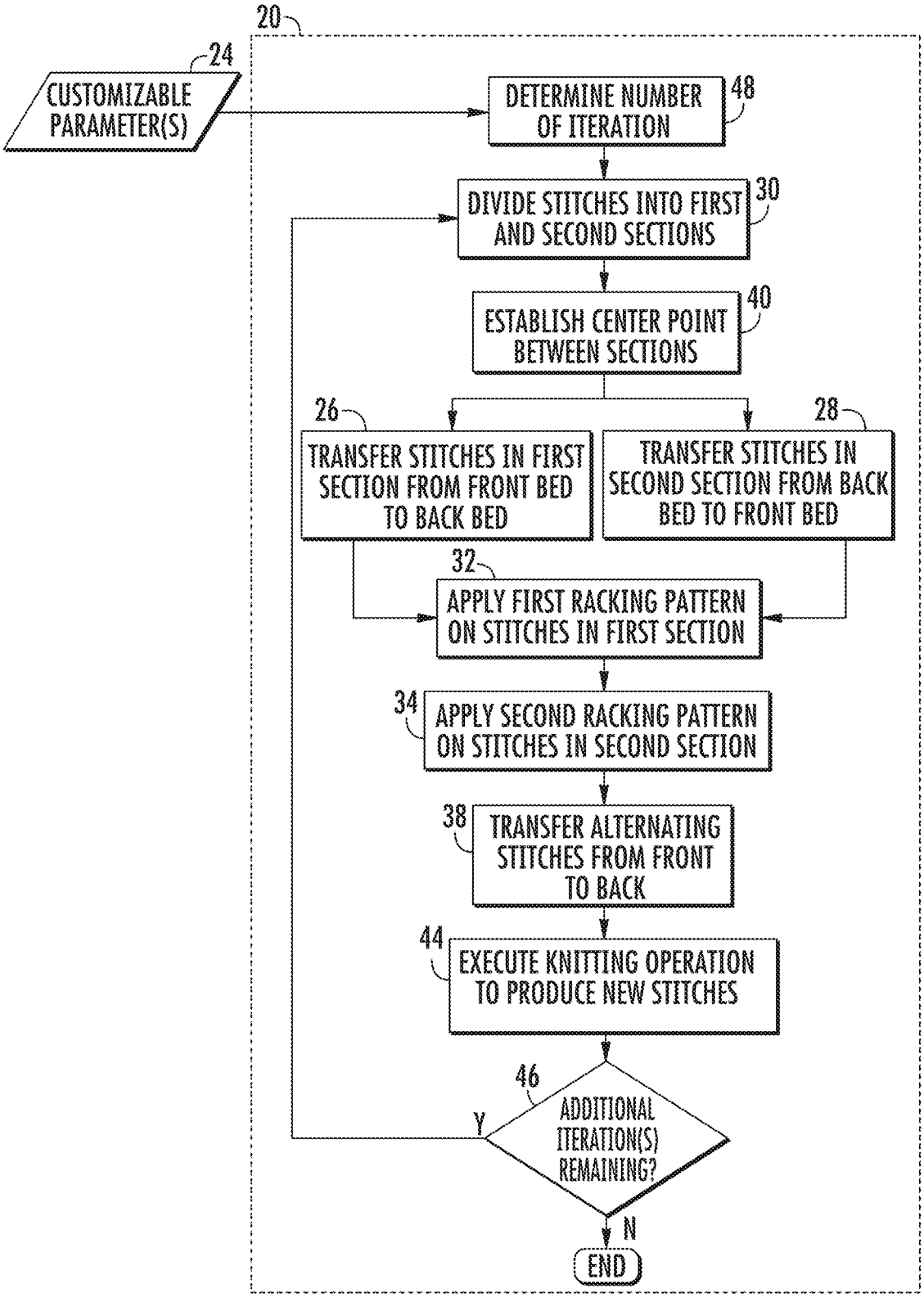
FIG. 2 is a flowchart depicting further detail for the method, including individual steps according to an aspect of the radial symmetry module.

The process described with respect to FIG. 2 is carried out in successive iterations that correspond with a number of stitches 114 present when the process is initially applied. In this manner, application of the radial symmetry module 20 may initially include determining 48 the number of iterations to be applied by radial symmetry module 20. This may be done in a manner that corresponds with or otherwise takes into account the customizable garment parameter or parameters 24. In one example at least one of the customizable garment parameters 24 may be the size of the garment 110, which for many garment types will influence the number of stitches 114 present along beds 118,122 by, for example, corresponding with a width of the garment. By doubling some adjacent stitches 114 on respective needles 116 and, thusly, replacing multiple stitches 114 in one row with single stitches 114 in a subsequent row, aspects of the radial symmetry module 20 may provide a reduction module, characterized by a reduction in the number stitches 114 from one row to another. In this manner, the number of iterations 46 can be determined by the number of stitches 114 present when module 20 is added to the pattern 18 in comparison to the number of stitches desired at the conclusion of radial symmetry module 20 along with the per-iteration reduction in stitches 114 of the radial symmetry module 20. In one example, as discussed further below, the radial symmetry module 20 may reduce the number of stitches 114 from one row to a subsequent row by sixteen stitches by doubling eight pairs of stitches 114 in particular locations along the row, as discussed further below, to achieve a particular appearance and characteristic of the radial symmetry exhibited by the corresponding portion of the garment 110. In such an example, the number of iterations may correspond with both the desired number of stitches 114 present at the end of the radial symmetry module 20 and the size of the garment 110, which may influence the number of stitches 114 present when radial symmetry module 20 begins. In the present example, there may be sixteen stitches 114 present when radial symmetry module 20 ends with radial symmetry module 20 executing six iterations beginning with one hundred and twelve (112) stitches 114. Optionally, the overall size of the garment 110 can result in more or fewer iterations. In one example, an additional iteration can allow radial symmetry module to begin with one hundred twenty eight (128) stitches, or one fewer iteration can allow radial symmetry module to begin with 96 stitches (with other arrangements being possible).

As presently described, the first transfer sequence and the second transfer sequence together reduce the number of stitches 114 by sixteen; however, the number of stitches 114 subjected to each of the transfer sequences 32,34 can vary according to various parameters, at least some of which may be customizable parameters. In this manner, the number of stiches 114 per section 112,120 (i.e. per row) may influence the number of iterations 46 determined in step 48. As can be appreciated by the specific examples given herein the number of stiches 114 per section 112,120 may be customizable characteristics 24 or may be influenced by characteristics 24 that take the garment size into account, but may be additional thereto.

Figure 3:
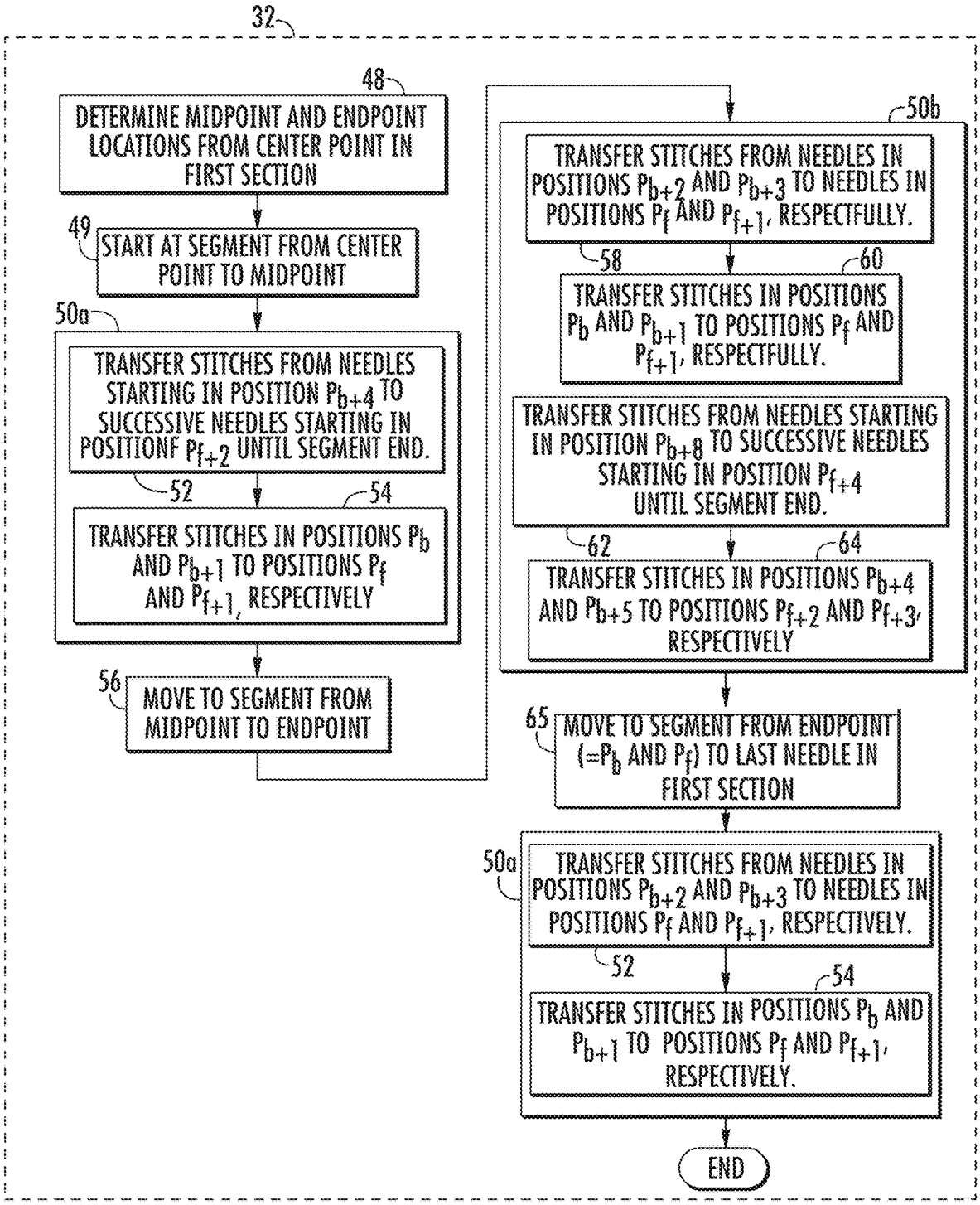
FIG. 3 is a flowchart depicting further detail for the radial symmetry module, including individual steps according to a first transfer sequence included therein.

The steps of the first transfer sequence 32 are shown in greater detail in FIG. 3 and are discussed with respect to the example needle beds 118 and 122 with corresponding schematic depiction of stitches 114 positioned thereon and by the initial transfer steps 26 and 28 (FIG. 2) during the individual steps of sequence 32 in FIGS. 5C-5J. Referring to FIG. 3, it can be seen that the first transfer sequence 32 may thusly include determining 48 a midpoint location 132*a* and an endpoint location 134*a* on the first side 126 of center location 124. As discussed above, the number of stitches 114 in the first section 112 can vary by a number of characteristics and parameters but will be half of the total stitches 114 in the operative row (the other half being in second section 120).

Figures 5A, 5B, 5C, 5D:
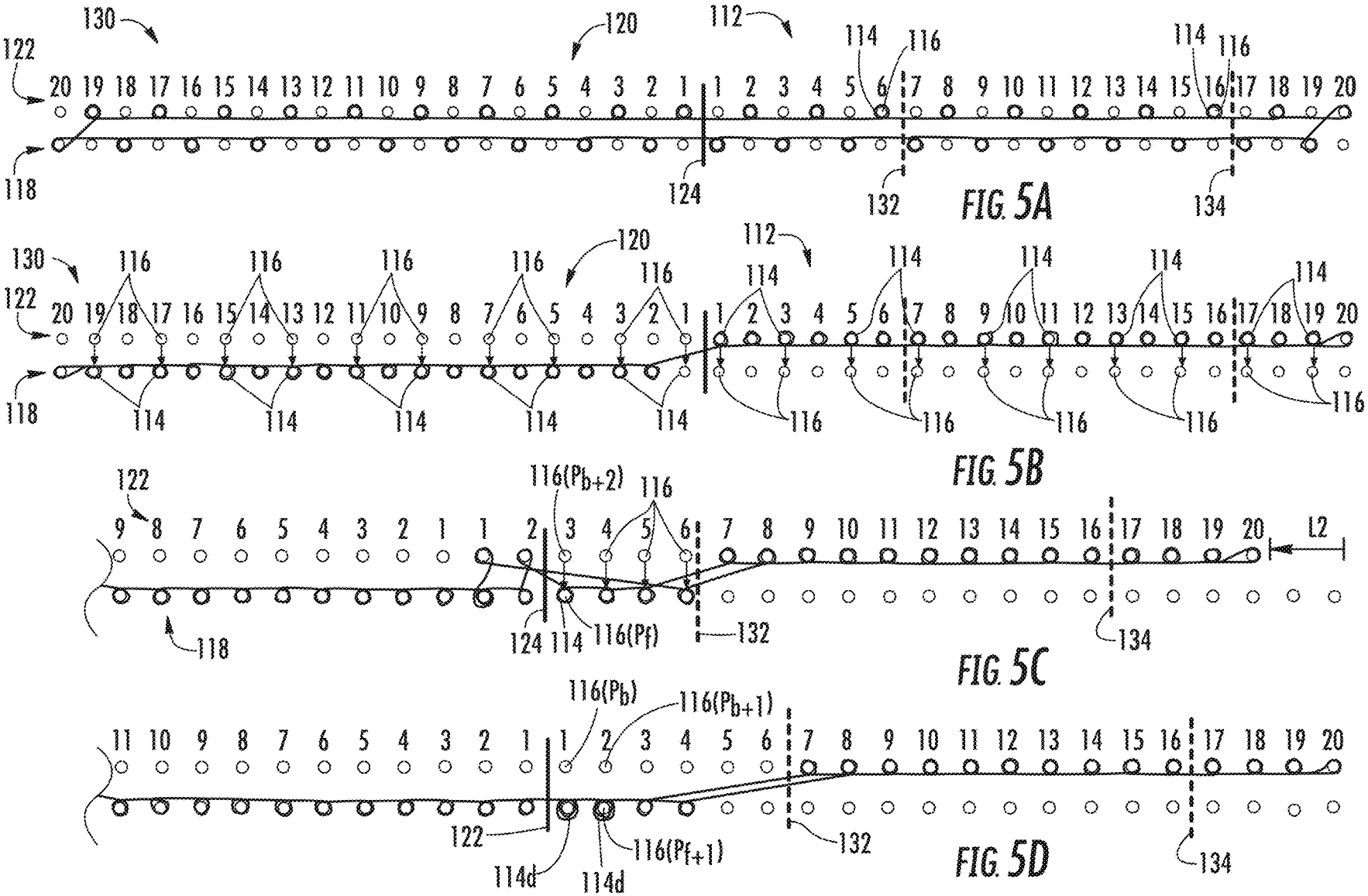
FIGS. 5A-5J are schematic depictions of automated knitting equipment in sequential steps of implementing an example of the first transfer sequence according to FIG. 3.

As discussed further below, the execution of radial symmetry module 20 can result in a portion 140 of garment 110 that includes a number of panel sections 144 that narrow toward the center 142 of the portion 140, the panels being defined and separated by ridges 146 that also converge toward center 140. The ridges 146 are formed by the doubled stitches 114*d* achieved by the first and second transfer sequences 32,34. Until at least the final iteration, the remaining stitches 114 will remain undoubled to define panel sections 144. The successive doubling of stitches 114 in particular areas causes the above-described reduction in the number of overall stitches 114 in successive rows, which will be appreciated as narrowing the garment 110 such that above-described iterations of the radial symmetry module 20 can converge garment 110 to the center 142 within the portion 104 created using radial symmetry module 20. Further, module 20 creates the desired radial symmetry by spacing the ridges 146 at regular intervals along the operative row and operating to maintain the width and relative location of the ridges 146 within the portion 140 of garment 110 overall. In this manner, it is the width of the panel sections 144 that reduce with successive iterations of radial symmetry module 20. Accordingly, the transfer sequences 32,34 are adapted to provide the same number of doubled stitches 114*d* in each iteration such that the number of remaining single stitches reduces evenly among the panel sections 144. In this manner, the midpoint location 132 may be determined to correspond with a halfway point between the central location 124 and the space after the last needle 116 in needle bed 118 having a stitch 114 thereon, or after the needle 116 corresponding with the number of stitches divided by two, as shown in FIG. 5B. Similarly, the endpoint location is considered as the location for the outermost ridge 146 and not the end of the stitches 114, which for reasons discussed further below is four positions from the last stitch 114 away from center location 124 within first section 112 or the total number of stitches 114 minus four, as also shown in FIG. 5B. It is noted that this determination corresponds with an implementation of radial symmetry module 20 that produces eight total panels 144 separated by eight total ridges of two doubled stitches 114*d* (i.e. four original stitches 114) and that the module 20 can be adapted to produce additional panels 144 by introducing additional midpoints at even intervals or to produce ridges 146 of different widths according to the principles discussed herein. In one aspect, the number of panels 144 and/or the width of the ridges 146 can be among the customizable parameters.

Once the midpoint location 132 and endpoint location 134 have been determined 48, the first step of the transfer sequence 32 is initiated, in which, beginning 49 from center location 124, what is referred to herein as an "underlapping" operation 50*a* is carried out. In general, the underlapping operation 50*a* (as well as 50*b*, discussed further below) is executed to position stitches 114 away from center location 124 on a needle 116 in first needle bed 118 beneath respective stitches 114 initially positioned closer to the center location 124. Because the first transfer sequence 32 is carried out on the first section 112, which extends from the center location 124 to the right, the rightmost (i.e. farther from center location 124) stitches 114 are transferred first to be positioned under the subsequently-transferred leftmost stitches 114, with the designation as underlapping being thusly derived. Accordingly, by starting at the center location 124, operative positions $P_b$ and $P_f$ on the second needle bed 122 and the first needle bed 118, respectively are defined at the first needle 116 from the center location 124 within the first section 112. On the initial step underlapping operation 50*a* is carried out in a single operation from center location 124 to midpoint location 132 with stitches 114 on the needles 116 from positions $P_{b+2}$ (i.e. needle 116 in position 3 in FIG. 5B) to the last needle in the segment (i.e., the last needle 116 before midpoint location 132, which is in position 6 in FIG. 5B) are transferred 52 to successive needles 116 in first needle bed 118. To facilitate this transfer second needle bed 122 is moved 52 to align the third needle 116 from the center position 124 with the first needle 116 in the first needle bed 118, as can be seen in FIG. 5C, which is such that the needles 116 in second needle bed 122 from which the stitches 114 are transferred are positioned directly across from the needles 116 in the first needle bed 118 to which the stitches 114 are transferred, in accordance with the transfer process of the subject knitting machine. This type of positioning is referred to generally as "racking" and is further described with respect to the direction (i.e. left ("L") or right ("R")) and the number of positions the second needle bed 122 is moved (i.e. a racking position of L2 in the present step 52 and as shown in FIG. 5C).

Subsequently, the stitches 114 on needles 116 in positions $P_b$ and $P_{b+1}$ are transferred 54 to the needles 116 in positions $P_f$ and $P_{f+1}$, which is carried out by moving second needle bed 122 to a racking position of zero, as shown in FIG. 5D. As shown, the first underlapping operation 50*a* results in the needles 116 in positions $P_f$ and $P_{f+1}$ having double stitches 114*d* and the remaining needles 116 having single stitches 114. In the illustrated example the needles in positions numbered 3 and 4 include single stitches, but more needles may include single stitches after transfer 54, depending on the position of midpoint location 132. In particular, the total number of needles 116 illustrated in FIGS. 5A-6J is reduced for simplicity over an example implementation that corresponds with the garment 110 illustrated in FIG. 7 in which the first row of stitches 114 on which module 20 is executed includes one hundred twelve stitches, with first section 112 including fifty six stitches 114. In such an example, midpoint location 132 would be positioned after needle 116 in position 28, meaning that twenty four single stitches 114 would be present in first needle bed 118 after transfer 54. Accordingly, the illustrated example in FIGS. 5A-6J is merely exemplary and can be scaled or appreciated according to an appropriate scale corresponding with the particular aspects of a given garment 110.

Figure 5E:
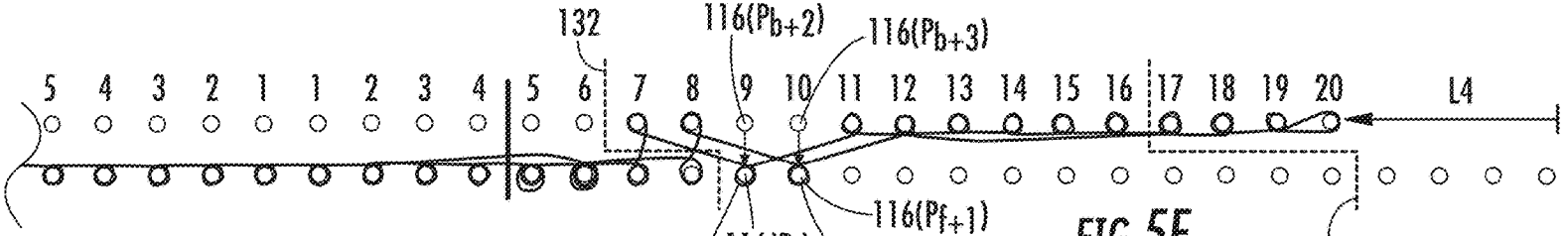
Figure 5F:
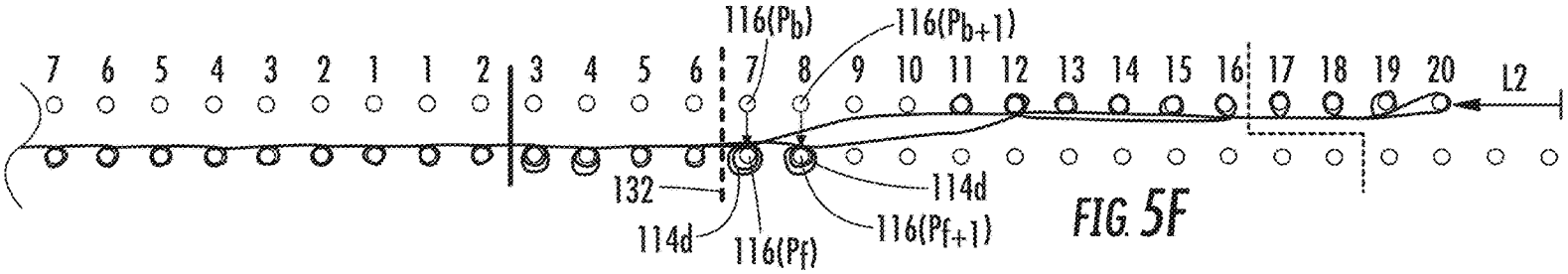
Figure 5G:
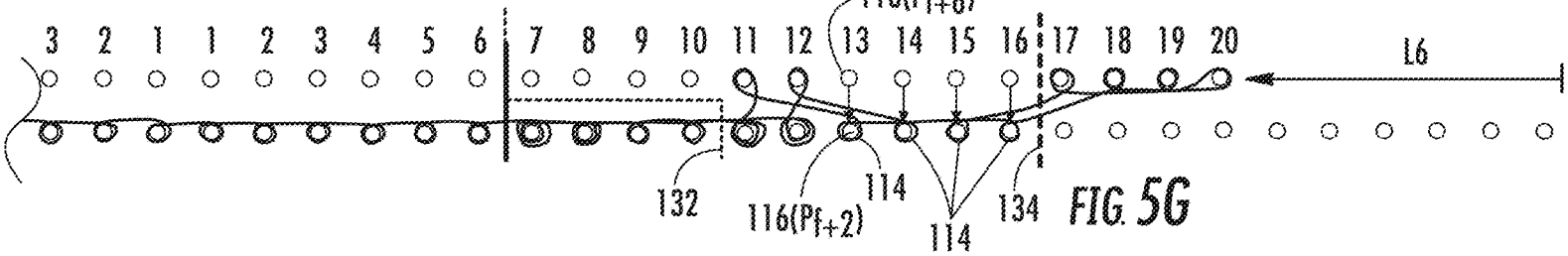
Figure 5H:
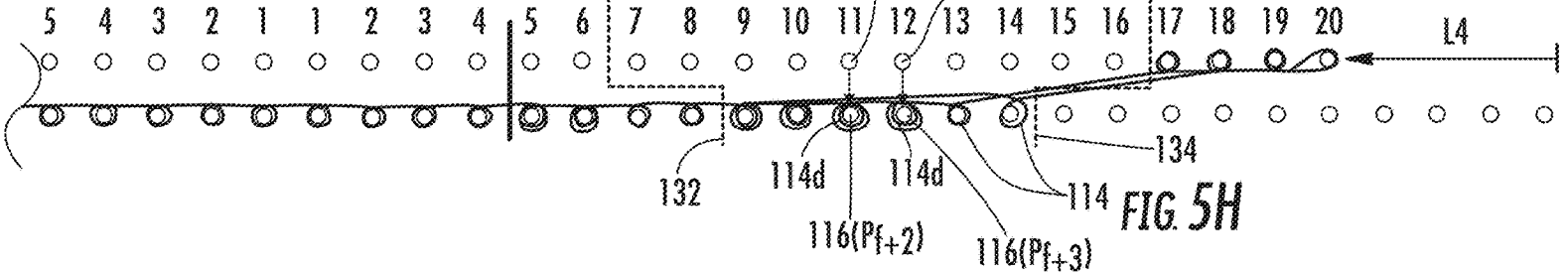
Figure 5I:
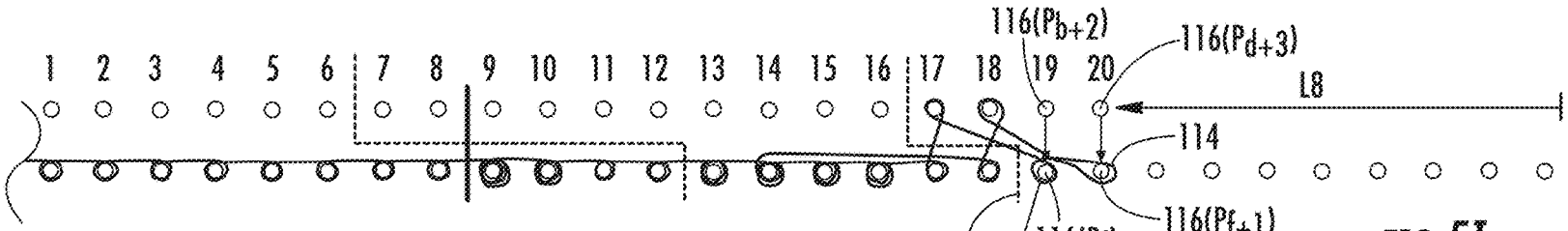

Subsequently, as second similar underlapping operation 50*b* is carried out on the next segment, which is defined 56 between midpoint location 132 of second needle bed 122 (with the first needle 116 after midpoint location 132 being designated as $P_b$). Notably, as the portion of stitches 114 on first needle bed 118 has been reduced by the underlapping operation 50*a*, the position $P_f$ is designated as the first unoccupied needle 116, which is unaligned in the zero racking position of FIG. 5C (and reflects the midpoint location 132 of the subsequent iteration). As can be seen in FIGS. 5E to 5H, the underlapping operation 50*b* executed past midpoint location 132 is a double underlapping operation that results in the first eight stitches 114 after midpoint location being doubled in successive pairs during transfer to the first needle bed 118. In this manner, the stitches on needles 116 in positions $P_{b+2}$ and $P_{b+3}$ are transferred 58 to the needles in positions $P_f$ and $P_{f+1}$ by racking second needle bed 122 to a position L4, as shown in FIG. 5E. The stitches 114 on needles 116 in positions $P_b$ and $P_{b+1}$ are then also transferred 60 to needles 116 in positions $P_f$ and $P_{f+1}$ (with second needle bed 122 moved back to an L2 racking position, as shown in FIG. 5F) resulting in the first pair of doubled stitches 114*d* thereon. The stitches 114 on needles 116 starting at position $P_{b+6}$ to the last needle 116 before endpoint location 134 are all transferred to the needles 116 in first needle bed 118 starting at $P_{f+2}$ with second needle bed 122 at a position L6, as shown in FIG. 5G. The remaining stitches 114 on the needles in positions $P_{b+4}$ and $P_{b+6}$ are then transferred over the previously-transferred stitches 114 on needles 116 in positions $P_{f+2}$ and $P_{f+3}$ with second needle bed 122 in position L4, as shown in FIG. 5H.

Figure 5J:
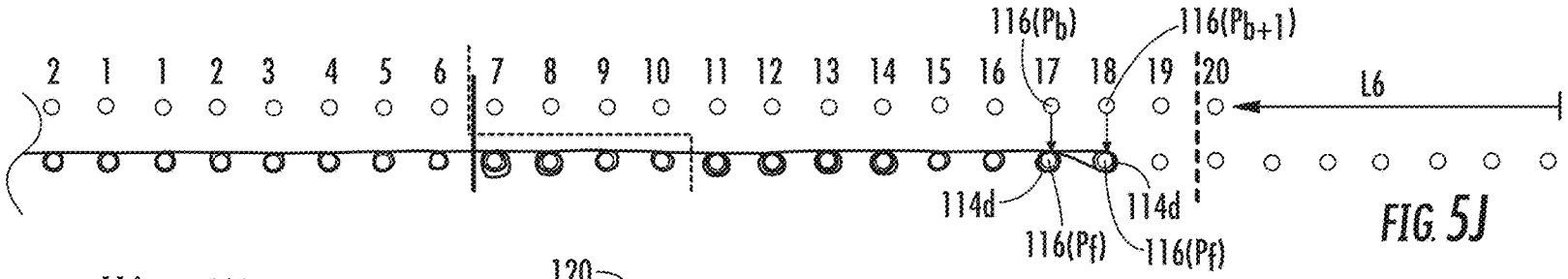

A subsequent single underlapping process 50*a* is then repeated past endpoint location 134, as shown in FIGS. 51 and 5J. For this application of underlapping process 50*a*, $P_b$ is set 65 at first needle 116 past the endpoint location 134 and $P_f$ is set at the first open needle 116 in first needle bed 118 in a manner similar to the designation 56 in connection with midpoint location 132, discussed above. In this manner, the execution of underlapping process 50*a* results in the stitches 114 in positions $P_{b+2}$ and $P_{b+3}$ (i.e. all remaining stitches in the section from $P_{b+2}$ on) being transferred 52 to the needles 116 in positions $P_f$ and $P_{f+1}$ with second needle bed 122 in an L8 position. The first transfer sequence 32 then concludes by positioning second needle bed 122 in an L6 position, as shown in FIG. 5J and transferring 54 the stitches 114 in positions $P_b$ and $P_{b+1}$ over the stitches 114 on needles 116 in positions $P_f$ and $P_{f+1}$ to produce a pair of doubled stitches 114*d* past endpoint location 134.

Figure 4:
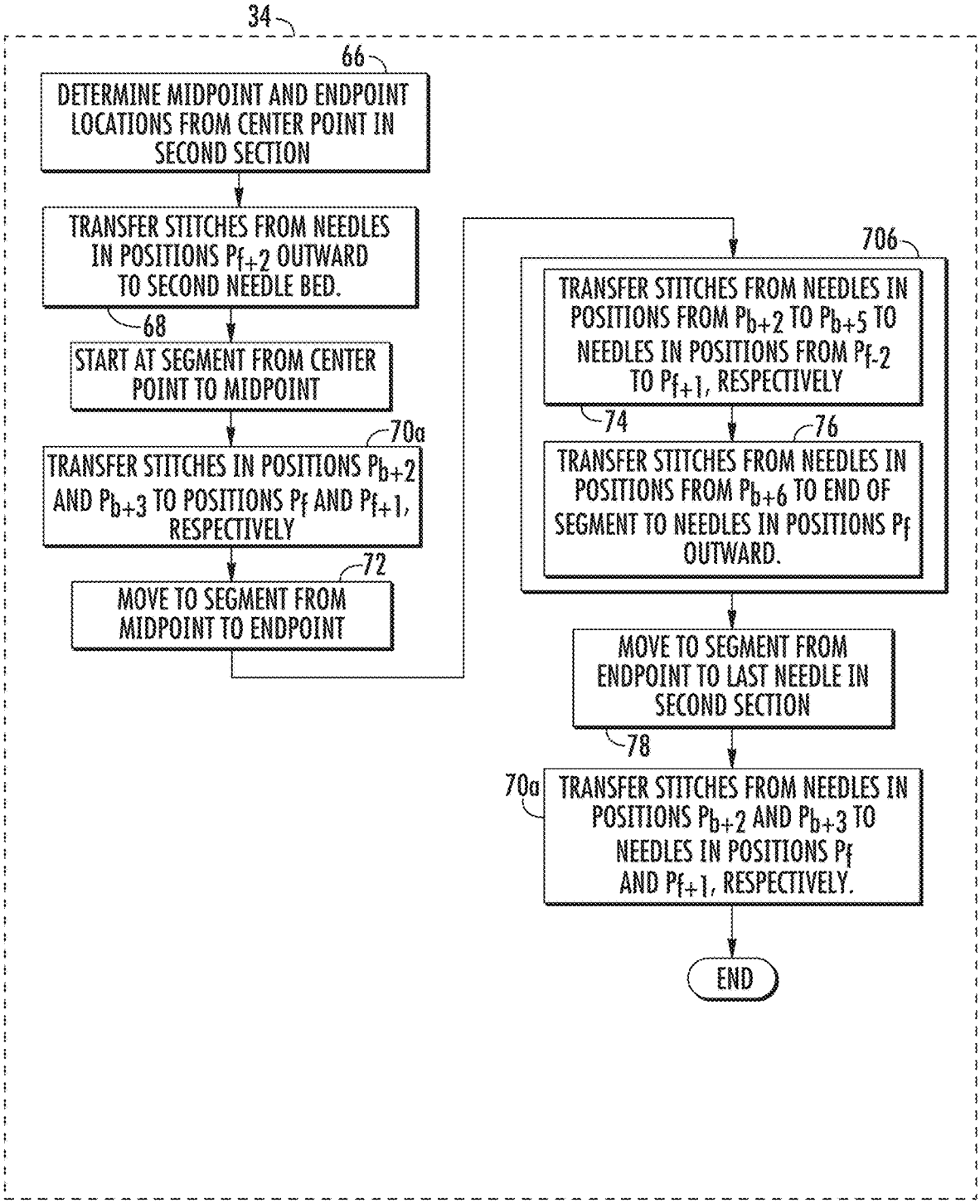
FIG. 4 is a flowchart depicting further detail for the radial symmetry module, including individual steps according to a second transfer sequence included therein.
Figure 6A:
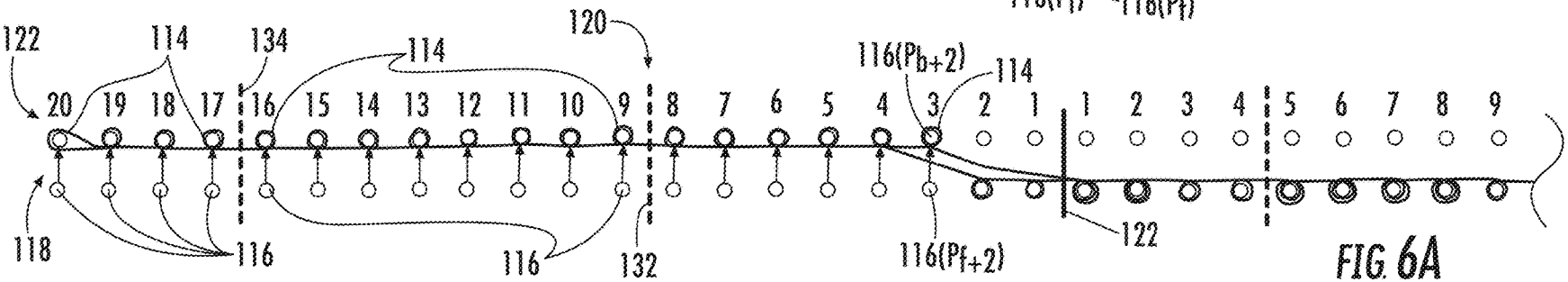
FIGS. 6A-6F are further schematic depictions of the automated knitting equipment in sequential steps of implementing an example of the second transfer sequence according to FIG. 4.

Turning to FIG. 4 and continuing with the schematic representation in FIG. 6A, the second transfer sequence 34 begins in a manner similar to the first transfer sequence 32 by determining 66 the midpoint location 132 and endpoint location 134 within the second section 120 of stitches 114. Similar to the first transfer sequence 32, the midpoint location 132 and endpoint location 134 are determined based on the location and configuration of the ribs 146 and the panel sections 144 separated and reduced by ribs 146 as they converge toward center 142. At least because radial symmetry module 20 is implemented to achieve radial symmetry within the portion 140 of garment 110 that it produces, the positioning and size (i.e. number of stitches doubled) of ribs 146 is the same as in the first transfer sequence 32. In this respect, endpoint location 134 is determined as the location before (in a direction away from center location 124) the second-to-last needle 116 having a stich 114 thereon, and midpoint location 132 in second section 120 is determined as the location after the needle 116 in a position equal to the number of stitches 114 in second section 120 minus four divided by two. Subsequently, the sequence is initiated by transferring 68 all of the stitches 114 from a position at $P_{f+2}$ (i.e., the third needle 116 from the center location 124 in first needle bed 118) to the outermost needle 116 from center location 124 having a stich 114 to the corresponding needles 116 on the second needle bed 120 (at a racking position of zero).

Figure 6B:
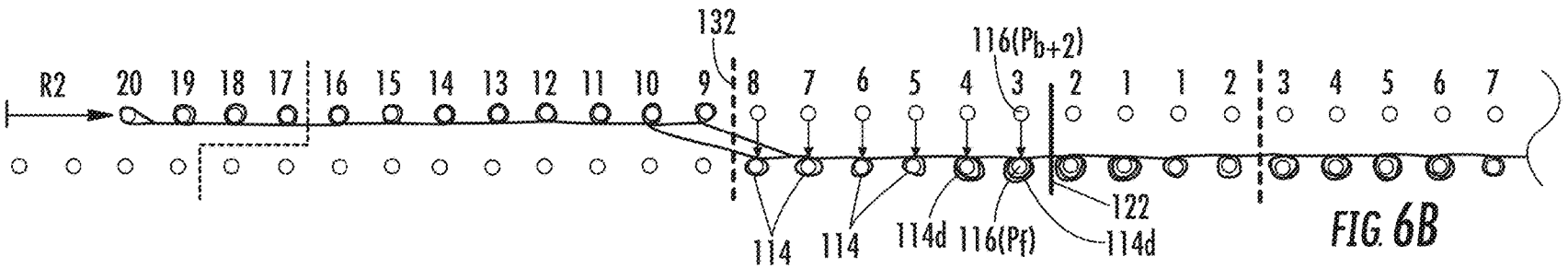
Figures 6C, 6D, 6E, 6F:
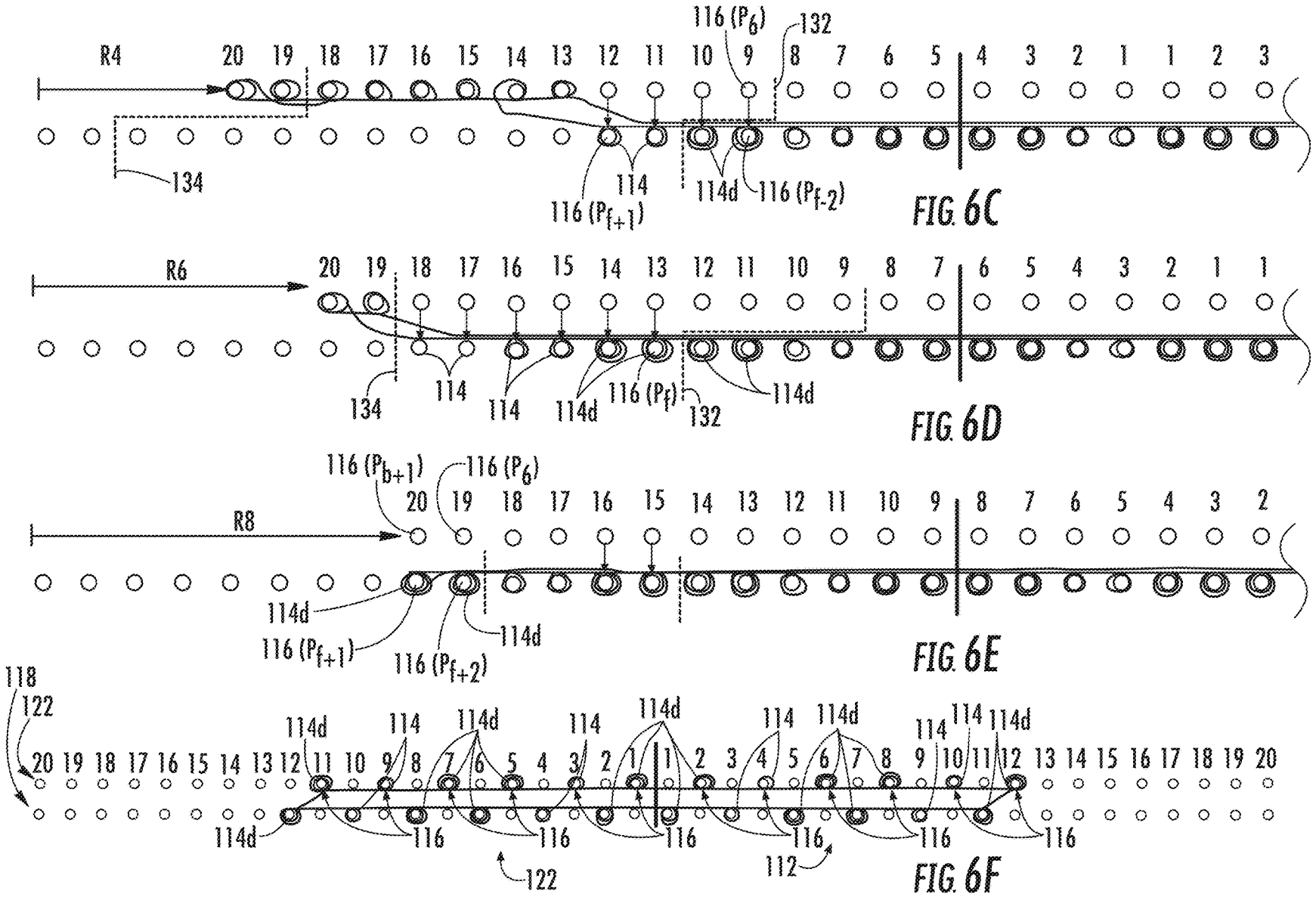

After the initial transfer 68, an overlapping operation 70*a* is executed in which a pair of stitches 114 is positioned over the next pair of stitches 114 closer to center location 124. By performing the above-described underlapping operations 50*a*,50*b* on stitches 114 within the first section 112 and the now-described underlapping operation 70*a* within the second section 120, the ribs 146 on either side of center location 124 will be formed by doubled stitches 114*d* that exhibit the same directional characteristics. In particular, in all ribs 146, the doubled stiches 114*d* will include a leftmost stitch 114 (in the orientation of FIGS. 5A-6F) positioned over a rightmost stitch 114. As shown in FIG. 6B, the overlapping operation 70*a* includes transferring the stitches 114 on the needles 116 in positions from $P_{b+2}$ to the end of the section of stitches 114 between center location 124 and midpoint 132 to sequential needles 116 starting at $P_f$ (in a racking position of R2) with the stitches from positions $P_{f+2}$ and $P_{f+3}$ being added over the previously transferred stitches 114 resulting in two more doubled stitches 114*d* adjacent center location 124. Subsequently, the sequence 34 moves 72 in a section from midpoint location 132 of second needle bed 122 outward toward endpoint location 134 with position $P_b$ set at the first needle 116 past midpoint location 132 and $P_f$ set at the first open needle 116 in first needle bed 122. A double overlapping operation 70*b* is then carried out in which second needle bed 122 is moved to a racking position of R4 and the stitches 114 in positions from $P_b$ and $P_{b+3}$ are transferred 74 to positions $P_{f-2}$ and $P_{f+1}$, respectively to form doubled stitches 114*d* on the two stitches inward of midpoint location 132 and to position single stitches 114 on the needles 116 in positions $P_f$ and $P_{f+1}$. Next, the second needle bed 122 is moved to a racking position R6 and the remaining stitches 114 from the needles in the positions from $P_{b+4}$ to the last needle 116 before endpoint location 134 are transferred 76 to successive needles starting at $P_f$, which results in two additional doubled stitches 114*d* in positions $P_f$ and $P_{f+1}$ with the remaining stitches 114 transferred being single stitches 114. Finally, the transfer pattern 34 moves 78 from the endpoint location 134 in second needle bed 122 onward with $P_b$ being set as the first needle 116 past endpoint location 134 in second needle bed 122 and $P_f$ being set as the first empty needle 116 in the first needle bed 118 and executes another single overlapping operation 70*a*. In particular, the remaining stitches 114 from $P_b$ outward are transferred to the needles 116 in positions $P_{f-1}$ and $P_{f-2}$, resulting in double stitches 114*d* on the needles in those positions. As all stitches in second needle bed 122 have been transferred to the first needle bed 118, the sequence 34 ends.

Returning to FIG. 2, when the second transfer sequence 34 is concluded, the stitches 114 and 114*d* arranged on the needles 116 in the first needle bed 118 are redistributed 38 among the first 118 and second 122 needle beds. As shown in FIG. 6F, this involves transferring alternating ones of the stitches 114 and 114*d* from the first needle bed 118 to the second needle bed 122. This operation is carried out such that the stitches 114 and 114*d* made up of stitches 114 that started on the second needle bed 122, either initially, or after a knitting operation 44 are transferred back to the second needle bed 122. As discussed previously, after such transfer a knitting operation 44 is performed on the stitches 114 and 114*d* to produce a new set of single stitches 114 vertically engaged with the previous stitches 114 and 114*d*. It is then determined 46 if an additional iteration is needed. If an additional iteration is needed, the process returns to the separation step 26 and proceeds as described above. If no further iterations are needed, the radial symmetry module 20 is concluded and the pattern generation process 14 resumes. As can be appreciated, subsequent operations in pattern generation 14 may include the addition of a further module or further modules, as called for in the particular garment. Alternatively, the radial symmetry module 20 may be the last module, at which point, it may be determined that the pattern 18 is complete. The pattern 18 may then be stored for immediate or subsequent manufacture of one or more garments 110 according to the pattern 18, which may be carried out according to the example scheduling and manufacture scheme, discussed further below.

Figure 7:
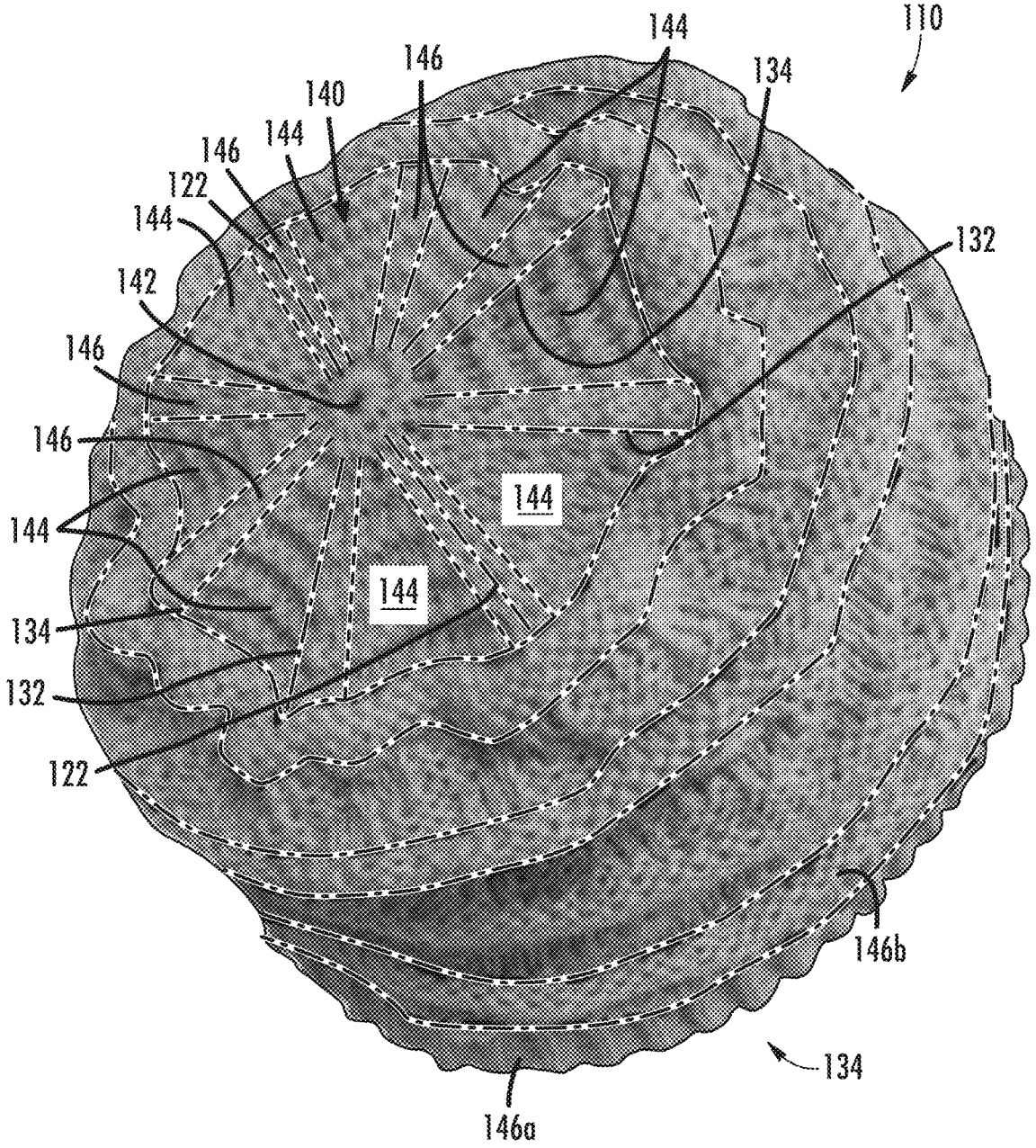
FIG. 7 is a perspective view of one example of a garment producible using a pattern generated according to the method of FIG. 1 and applying the radial symmetry module of FIGS. 2-4.

Turning now to FIG. 7, one example of a garment 110 produced according to a pattern 18 produced by the above described method 10, including the use of radial symmetry module 20 is shown. In particular, the garment 110 is illustrated as a knitted hat that has a generally tubular body 136 with a lower open end 138 and a closed top portion 140. As can be seen, the top portion 140 is comprised of stitches in a pattern that converges around the center 142 within the top portion 140 of the garment 110. In this manner, the illustrated garment 110 is one example of a garment that can be produced on automated knitting equipment 130 using a pattern 18 produced by the above described method 10 using radial symmetry module 20 to produce the knitting instructions to complete the top portion 140. In the particular example depicted in FIG. 7, the top portion 140 includes a plurality of distinguishable sections 144 and 146 that have characteristics exhibiting radial symmetry about center 142. In particular, such top portion 140 includes a number of ribs 146 and a corresponding number of panels 144, with the ribs 146 exhibiting greater density of stitches 114 and an elevated position with respect to the panels 144. These characteristics are achieved by application of the radial symmetry module 20, as described above, in which the ribs 146 are achieved by the above-described doubling of stitches 114*d* about the center location 124, the midpoint location 132, and the endpoint location 134. As discussed above, because the doubling of stitches 114*d* is carried out over the same number of stitches, the ribs 146 appear consistent in width, while the panels 144 narrow between ribs 146 as they converge toward center point 142.

As can be appreciated by a comparison of FIGS. 6F and 7, the iterations of radial symmetry module 20, including the transfer sequences 32,34 and subsequent knitting operation (s) 44 produce two ribs 146 on opposite sides of the top portion 140 that extend along center location 124 as it extends toward center point 142. Notably, the ribs 146 along center location 124 include a doubled stitch 114*d* on each side of center location 124, which respectively result from the first underlapping 50*a* and overlapping 70*a* operations carried out in the first transfer sequence 32 and the second transfer sequence 34, respectively, with one each of the respectively underlapped and overlapped doubled stitches 142 being separately associated with the ribs 146 on either side of top portion 140. In a similar manner, top portion 140 also includes two respective ribs 146 extending along each midpoint location 132 as it is extended toward center point 142, resulting in four such ribs 146 within top portion 140. Because the first and second transfer sequences 32,34 generate respective pairs of ribs 146 (one ultimately positioned in second needle bed 122 in FIG. 6F and one in first needle bed 118) in their entirety, two pairs of doubled stitches 114*d* are formed during each sequence 32,34 adjacent the midpoint location 132. Finally, it can be seen that the top portion 140 includes only one rib 146 along the respective endpoint locations 134 of the first and second sections of stitches 114, only a single pair of doubled stitches 114*d* are formed by the respective sequences 32,34, as the doubled stitches 114*d* remain adjacent to each other when the stitches 114*d* are separated 38. As a result of the execution of radial symmetry module 20 in this manner, all of the ribs 146 include two adjacent doubled stitches 114*d* through each successive row toward center point 142 of the top portion 140. Further, the above-described operation results in panels 144 all having the same number of single stitches 114 therein for each row and converging toward center point 142 in a radially-symmetric manner. In addition, the difference in the order at which the respective groups of stitches 114 are added to the respective needles 116 in the first and second transfer sequences 32,34 results in the direction of doubling of such stitches 114 being the same between the first and second sections 112,120 so that the sections 112,120 converge toward the center point 124, while the top stitches are all oriented in the same direction (i.e., from left to right within the frame of reference established in FIGS. 5A-6F).

As can be appreciated based on the above discussion, the application of a single instance of the first transfer sequence 32 and the second transfer sequence 34 on respective single first and second sets 112,120 of stitches 114 (and depicted schematically in FIGS. 5A-6F) produces a single pattern section 140 that converges about center point 124 to the center point 138 of the corresponding section 136 of the garment 110. Accordingly, a number of simultaneous applications of the first and second transfer sequences 32,34 can be applied to multiple, respective first and second sets 112,120 of stitches 114 about respective central locations 124, each emanating from a corresponding portion of stitches resulting, for example, from the portion of the garment produced by a preceding module application. In the example shown, top portion 136 of hat 110 includes eight pattern sections 140, meaning that eight simultaneous applications of the first and second transfer sequences 32,34 can be applied by a thusly-adapted radial symmetry module 20 such that the pattern sections 140 are formed simultaneously extending from the body portion 132 of hat 110. In some instances, the individual pattern sections 140 may not be closely or finally joined together, such that an additional finishing step of stitching together the pattern sections 140 and closing the top 136 about the center 138 may be needed. Even in such cases, the garment 110 is considered generally seamless because of the nature by which the body portion 132 is formed and the corresponding principles by which pattern sections 140 are formed simultaneously from body portion 132.

Figure 8:
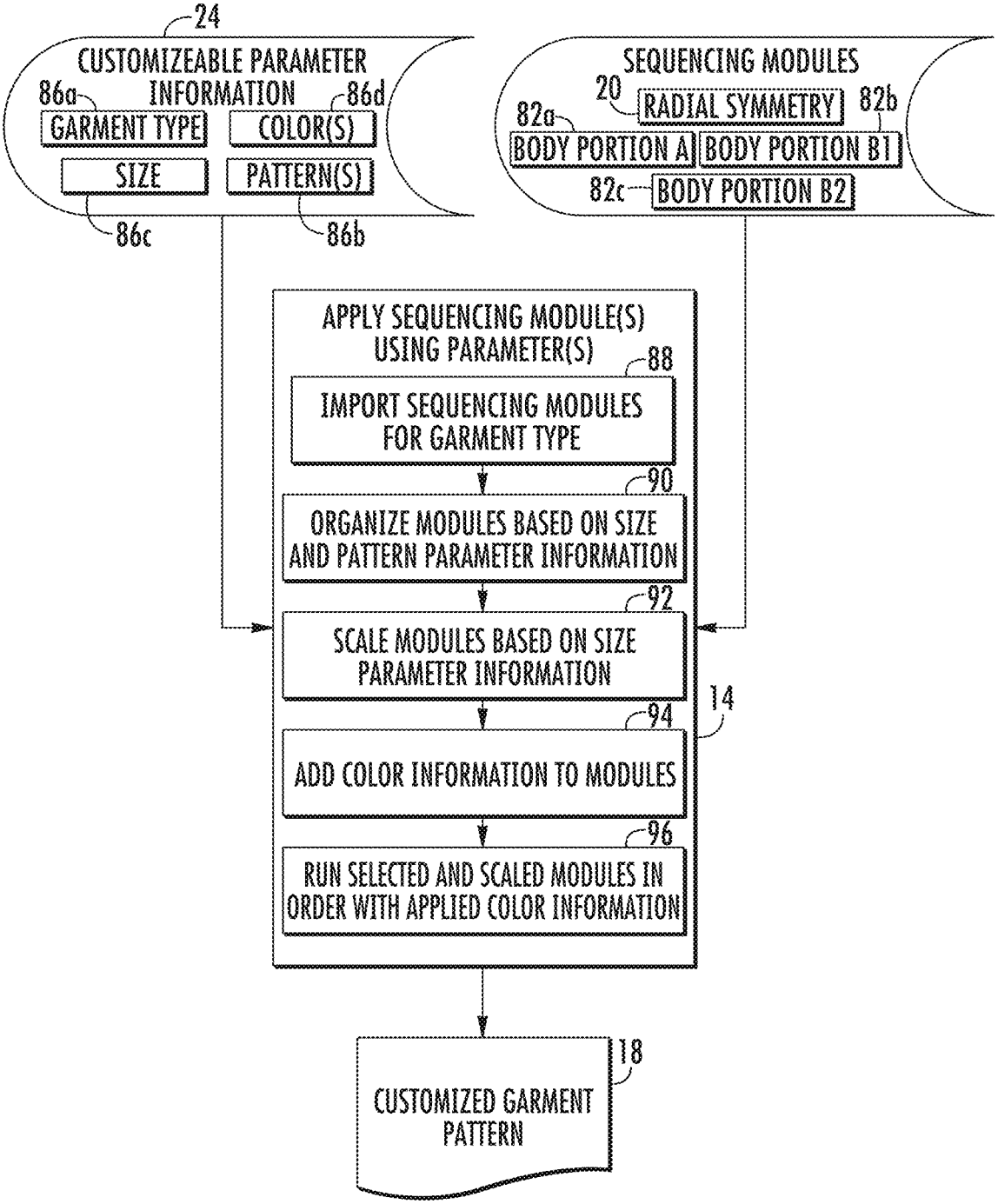
FIG. 8 is a flowchart depicting further detail for the method of FIG. 1, including steps for customizing the pattern according to customizable parameter information.

To derive a complete pattern for the seamless production of an entire garment 110 such as the hat depicted in FIG. 7, the step of applying the sequencing modules 14, discussed above with respect to FIG. 1, and which includes the application of radial symmetry module 20 just described, may be expanded according to the example shown in FIG. 8. In particular, a number of different sequencing modules 84 can be stored in memory along with radial symmetry module 20 and can be accessible by the logic or programming used to derive pattern 18 in the process 14 shown in FIG. 8. In this manner, the programming can also access the customizable parameter data 24, which can include information relating to a number of different parameters 86, including a garment type 86*a*. In this manner certain ones of the modules 20,84 can be associated with one or more garment types such that the pattern assembly 14 can begin by importing the various ones of sequencing modules 20,84 associated with the garment type 86*a* (step 88). In this manner, a number of different modules 84, in addition to radial symmetry module 20 may be associated with garment type 86*a* indicating a hat. As shown in FIG. 7, the depicted hat 110 may include a number of different knitted portions 146 within the body 132, all of which can be accessed and imported 88 when a garment type 86*a* for a hat is in the customizable parameter data 24.

As can be seen in FIG. 7, the body 132 of hat 110 includes a lower ribbed portion 146*a*, three separate reverse-stitched portions 146*b*, a diagonal cable portion 146*c*, and an upper ribbed portion 146*d* with top portion 136 extending from an uppermost instance of the reverse-stitched portion 146*b*. In one example, such an arrangement of portions can be specific to a particular type of hat, such that the selected garment type 86*a* may correspond with a specific style of hat 110 thusly arranged (with other hat styles having different compositions also being pre-designed and selectable). In another example, the particular selection and arrangement of portions 146 can be a customizable parameter. In particular, a user may be allowed to select the particular composition of a number of pre-established portions of the garment (such as from the types illustrated and/or additional types) or may be allowed to "build" their own hat by assembling various predetermined portions 146. In either such example, the parameter information 24 may also include data related to the patterning 86*b* that can be used to organize 90 a number of different modules 84*a*,84*b*,84*c*, including radial symmetry module 20 in the present example, based on the patterning data 86*b*. In addition, such organization 90 may incorporate the size data 86*a* such that certain ones of the modules 84*a*,84*b*,84*c* may be repeated to achieve the desired sizing of garment 10 (e.g., by way of height, length, etc.).

Subsequently (or initially, when the patterning is specifically associated with the garment type 86*a*) the selected modules 84*a*,84*b*,84*c* can be scaled 92 based on size data

86*c* by which garment size is a customizable parameter and is included in the parameter information 24. It is noted that the sizing information may be included in the garment type 86*a* in a similar manner as the pattern (e.g., a large hat, style X), in which instance the scaling step 92 is also skipped. Alternatively, sizing information may be taken as a head circumference measurement and may be associated with a particular predetermined size, may be treated as a custom size with scaling 92 being carried out to match the measurement as closely as possible, or may be associated with a batch-processed size with scaling 92 being applied in bulk to a predetermined number of garments 110 associated with the particular processed sizes, as discussed further below.

In general, each module 84*a*,84*b*,84*c* can include information on scaling, such as by how to properly include more or fewer stitches 114 in a single knitting operation associated therewith in the context of any specific characteristics of the module (i.e. ribbing, cabling, etc). The programming executing the pattern generation 14 can specifically scale each module 84*a*,84*b*,84*c* according to included logic and/or can sequentially size the modules 84*a*,84*b*,84*c* according to the prior organizing 90 such that an initial number of stitches 114 is fed forward from the previous module scaling. In this manner, radial symmetry module 20 can be similarly scaled. In one example, a number of body pattern sections 140 and stitches 114 included therein by radial symmetry module 20 can be dictated directly by the sizing information 86*c* or can be determined based on the number of stitches 114 included in body portion 146*b* from which it extends. In such an example, the number of ribs 146 and panels 144 can be predetermined with the number of stitches in either or both of the first and second sections 112,120 being dictated by the sizing. In yet another example, the number of pattern sections 140 can be a customizable parameter such that the application of radial symmetry module 20 includes both patterning 86*b* and sizing data 86*c*. As discussed above, the number of stitches included in each application of radial symmetry module 20 can influence the number of sequences in module 20 and can, therefore, further affect—or be affected by—the sizing 86*c* of garment 110. In an aspect the programming executing the pattern generation 14 can include logic or other programming to scale the various modules according to a number of such factors simultaneously.

After the module scaling 92, additional customizable parameter information 24 in the form of color data 86*d* can be applied to the assembled and scaled modules (alternatively, this can also be done in connection with the scaling). In various aspects, the garment 110 can be of a single color selectable from a number of colors or the garment 110 can be of a number of colors (such as with respect to each separate portion 136 and 146*a*-*d*, etc.), or a number of different coloring/striping patterns may be applicable to the garment overall as an overlay to the selected garment irrespective of the particular patterning. In any such aspect, the information 86*d* can be accessed during the pattern assembly 14 and applied 94 to the pattern to arrive at a specific application of pattern 18 that is customized by one or more of garment type 86*a*, patterning 86*b*, size 86*c*, and color data 86*d*, with additional parameters being similarly accounted for in assembly 14. In this manner, the automated equipment 130 can produce a customized garment that includes a radially-symmetric portion 136 that by application of the radial symmetry module 20 based on at least one customizable parameter.

Figure 9:
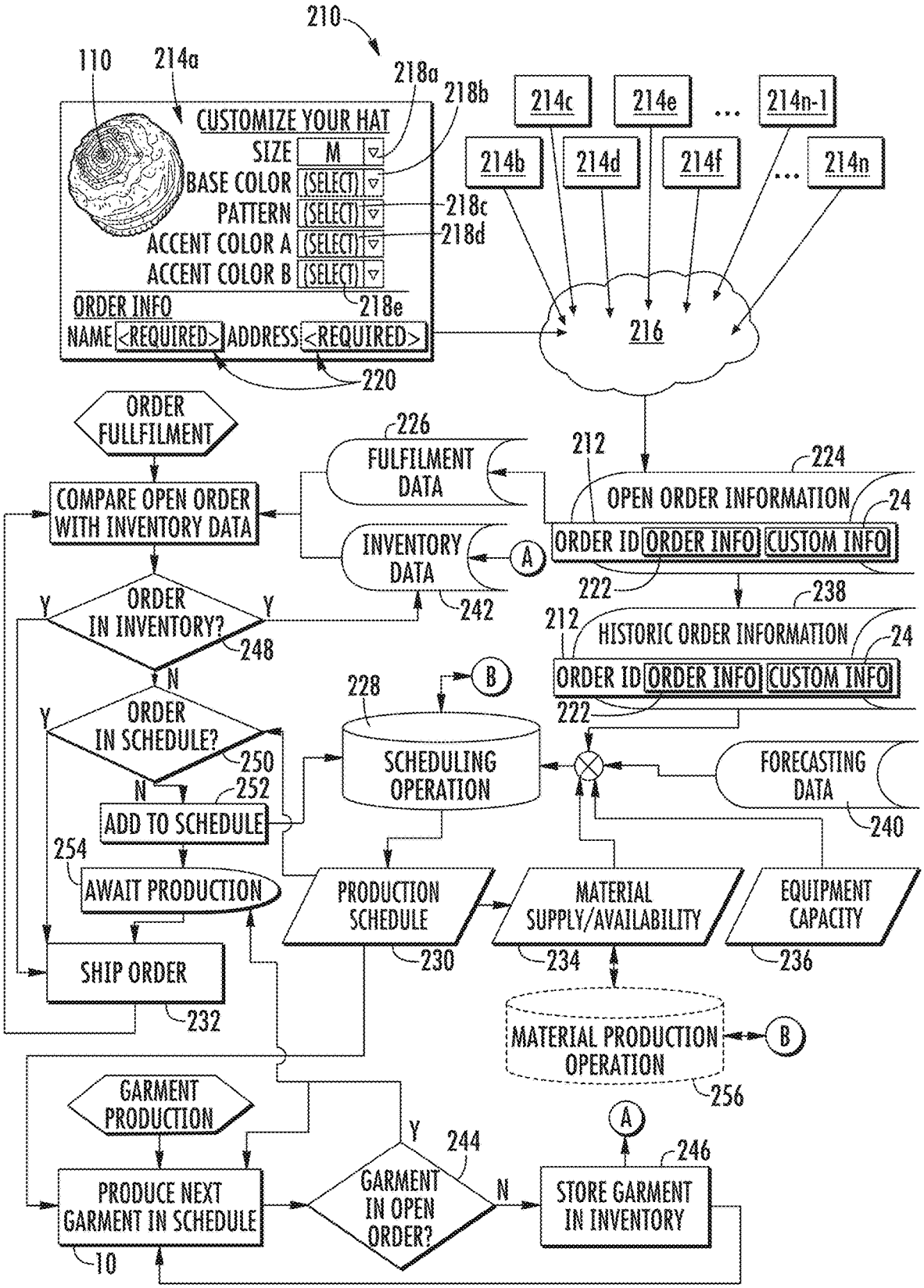
FIG. 9 is a system diagram showing a system configured to receive custom garment orders and produce at least some garments according to the custom garment orders by the method of FIG. 1.

Turning now to FIG. 9, the above described method 10 of FIG. 2 and the various implementations thereof, including the application and customization of radial symmetry module 20, as described in FIGS. 2-8, can be incorporated into a garment production system 210, an example of which is depicted schematically. According to various aspects, the production system 210 can receive the customizable parameter information 24 for a number of different garments 110 to be produced and schedule the manufacturing of such garments. As shown, the system 210 may be configured to receive the customizable parameter information 24 in connection with a plurality of orders 212. These orders 212 may be received by system 210 by way of an ordering interface 214 that can be accessed via the internet 216, such interface 214 being configured to allow a purchaser to select and customize one or more garments to be produced and fulfilled by system 210. In this manner, the customers may be individuals or retailers, with the interface 214 optionally being tailored to the ordering needs of the customer type. In the example illustrated in FIG. 9, the interface 214 may include fields 216*a*-*e*, that can be populated by the user and can correspond with the customizable parameter data 24 desired, including the above-discussed size 86*c*, pattern 86*b*, and color data 86*d*, available for the selected garment type 86*a* (for which the selection thereof may be provided for separately within interface 214). In this manner, the customer/user may be able to assemble an order 212 with one or more customized garments of, optionally, different types 86*a* and/or according to different additional parameters. As can also be seen, the interface 214 can include additional fields 220 that can include other order information 222 including shipping information, payment information, and the like. In this manner, system 210 can take a plurality of orders 212 from a number of different customers by way of separately accessible implementations of the interface 214*a*-214*n* at a plurality of remote locations via the internet 216. Each such order 212 can be stored in open order data 224 in which the customizable parameter information 24 for a number of different garments can be associated with the specific order information 224, such as by a unique order ID or the like.

As shown, the open order information 224 can be fed into fulfilment data 226 for scheduling of the various garments associated with open orders 212 according to a specific operation 228. In one aspect of the scheduling operation 228, can produce and maintain (such as by real time adjustments and modifications) a production schedule 230 that includes the information needed to produce the various garments to fulfill orders 212, including the customizable parameter data 24 and other information needed to generate the patterns 18, as discussed above according to method 10. The schedule 230 may include such information according to an order of garment production that is determined by scheduling operation 228 to optimize or enhance the efficiency with which the garments 110 are produced 10 and the orders 212 are fulfilled (i.e. by shipping 232). As shown, such information can include a current supply and/or availability of the materials 234 (e.g., yarn, thread, etc. of specific type, gauge, composition, color, etc.), as well as the capacity 236 of the equipment 130 needed to produce the garments 110. In this manner, scheduling operation 228 can result in orders 212, even those for different garment types 86*a*, using similar materials 234 according to their availability and distribution of such materials among the available equipment 130 being scheduled to run in groups using similar materials and distribution of the orders over the equipment 130 accordingly.

The scheduling operation 228 can also process the order information 222 in various ways to maximize fulfilment efficiency. In one aspect, geographic information can be pulled from the shipping information to group orders 212 to be shipped to a similar geographic region. In another aspect, the order information 222 can include a date stamp that can be used to ensure that the consideration of material availability 234 or equipment capacity 236 does not require orders 212 to wait a time interval deemed excessive for fulfillment. In a similar manner, such information can be used to intersperse small orders into large orders having similar customizable parameter information 24 to prevent large orders, such as from retailers, causing delays for individual customer orders. As discussed above, the scheduling operation 228 can be used in connection with aspects of the pattern generation module 14 discussed above to mutually increase efficiency in production. In particular, in the variation discussed above, wherein the sizing information 86*c* is taken from each customer 214 in the form of a head circumference measurement, periodic order information 222 can be aggregated and processed to batch-process a number of particular sizes (for example, small, medium, and large) that are selected to efficiently fulfil the orders with garments 110 produced in runs of the same size (e.g., using scaling step 92) with an acceptable fit among certain groups of head sizes. In this manner, scheduling operation 228 can take process orders 212 over a predetermined time frame, such as two days (or in other examples, one week, one month, etc.), or over a predetermined quantity and cluster the orders based on the distribution of sizing information 86*c* among the orders 212 given certain parameters, such as maximum deviation from any given measurement per derived sizing range, and determine the number of sizing groups needed and the particular sizes. Scheduling operation 228 can then group the orders for production 10 according to the assigned size and can associate scaling 92 information with the orders 212 so that the designated sizes can be produced together in a single batch (with additional scheduling based on other parameters) with increased production efficiency based on increased flexibility in the supply chain and a corresponding allowance for interchangeability in subcomponents. Such an operation may be particularly useful when the particular garment 110 can take advantage of the inherent compliance of knitted garments, such as the illustrated hat 110, where a snug fit by some extension of the knit is expected or desired. As the compliance characteristics of a garment 110 can vary based on the material used and/or the particular aspects of the knitting operation (tension, structure, etc.), in another similar aspect the size ranges can be developed at the outset of a product program, when the compliance of the textile is characterized or identified, to realize some of the above-discussed efficiency gains, while providing a more reliable or repeatable fit characteristic among garments 110.

In a further aspect of system 210, the information from orders 212, including the customizable parameter information 24 and aspects of the order information 222 can be stored in historic or archived data 238 that can be used by the scheduling operation 228 to predict orders 212 likely to be placed, including by geographic distribution and timing (e.g. season), or at least information about such orders, such as materials that will likely be needed and in what amount/quantity. In one aspect, this data 238 may be useable by the scheduling operation 228 to manufacture garments 110 according to anticipated orders according to predicted timing and quantity and incorporating predicted customizable parameter information 24. This can allow production 10 of garments 110 to be scheduled and associated with predicted customizable parameter data 24 and predicted order information 222 to be accordingly added to schedule 230 along with actual orders 212. In this manner, some of the garments 110 in open orders 212 may be scheduled or actually produced before the order 212 is placed, which can allow for shorter or even immediate fulfilment 232 of such an order 212. In various examples, the historic data 238 can be used to predict the types of garments that are ordered in particular sizes and colors among certain geographic regions at various times and can add the production of such garments in predicted quantities at predicted times to schedule 230 with such garments 110 being manufactured according to modeling conducted by scheduling operation 228 using data 238.

By way of example, the modeling may determine that garments 110 suitable for cold weather (e.g. hats or garments having thicker material) in darker colors are ordered in late fall in cold weather regions, or that size distribution among regions varies in a predictable manner and can be associated with garments typically ordered at certain times and associated with such regions (e.g. to predict size data). These and other patterns may be predicted by scheduling operation 228 and added to the schedule 230 accordingly. In a similar manner, scheduling operation 228 may be able to predict and anticipate the timing of large orders, such as from retailers (e.g. in a certain time interval prior to holidays, retail seasons, etc.) such that large orders can be accounted for (including by way of sizes, colors, garment types, and the like predictably ordered by certain retailers).

In one aspect, forecasting data 240 can also be used by the scheduling operation 228 to allow for adaptation of the historic data 238 over time. This can allow the scheduling operation 228 to adjust the anticipated orders (by timing, characteristic, quantity) to account for changes in trends, demographics, and other factors. In one example, forecasting model 240 can include information regarding color trends to prevent garments in outdated colors from being scheduled too heavily or to anticipate the increase in orders of garments in upwardly-trending colors. In this manner scheduling operation 228 can also be tuned to account for changes in sizing preference over time or uncharacteristically cold or warm weather in certain seasons or regions.

Further, the use of the scheduling operation 228 can allow for inventory 242 to be kept of garments 110 produced according to anticipated orders, which can help to enhance the efficiency gains from using scheduling operation 228. Further, the use of scheduling operation 228, including using the above-described historic data 238 and forecasting data 240, can help maintain inventory 242 at acceptably low levels (including by setting limits on inventory within scheduling operation 228). As further depicted in FIG. 9, the production 10 of garments 110 according to the schedule 230 produced by scheduling operation 228 may include garments 110 that correspond with open orders 212 interspersed with garments 110 corresponding with anticipated orders. In this manner, garments that are not associated 244 with an open order 212 can be placed 246 in inventory 242, which can be reflected in data maintained in system 210. Accordingly, when an order 212 is received in the open order information 224 and processed in the fulfilment data 226, it can initially be compared 248 with the inventory data 242. If a garment 110 in inventory 242 corresponds with the order 212, it can immediately be shipped 232 for fulfilment. If a corresponding garment 110 is not in inventory 242, system 210 can check to see if a corresponding garment 110 is in the schedule 230, at which point, the anticipated order can be associated 244 with the actual order 212 and can be fulfilled 232 when it is produced 10. In the event that no garment 110 corresponding with the order 212 is already in schedule 230, the system 210 can pass 252 the order to scheduling operation 228 to add the corresponding garment (s) to the schedule 230 in the manner discussed above with a delay 254 that is balanced with the desire to produce 10 the garment 110 as quickly as possible with the other, above-described production and fulfilment concerns. When the corresponding garment(s) 110 have been produced 10, the order 212 is fulfilled 232. In this manner inventory 242 can be used to balance a desire to provide quick or just-in-time production 10 with other concerns, including production capacity and/or variations in order volume over time.

As can be appreciated, the ability for scheduling operation 228 to accurately schedule predicted orders may inversely vary with the number of customizable parameters 24 it must consider and account for. Accordingly, interface 214 may be adapted to provide options for garments of varying levels of customization. For example, options for variations in size and color for certain garments may be provided as "quick order" options, and the anticipated orders added by scheduling operation 228 can be restricted to the subset of garments resulting from the permutations of customizable parameters 24 relating to the quick orders. In this aspect, further customization options can be provided for customers outside of the quick order context, with it being made known that higher levels of customization may impact the speed of order fulfilment. In a further aspect, scheduling operation 228 may be able to provide information regarding the estimated time for fulfilment to the customer by way of interface 214 during the ordering process. Such information can, in some aspects, be adapted to the particular customizable parameter information 24 being input on a real-time basis.

In a further aspect, the scheduling operation 228 can be used in the ordering and/or production of materials 234 based on both customer orders 212 and anticipated orders, as well as forward-looking data used to derive the anticipated orders. In particular, the need for certain materials, taking into account current supply, at certain times can be communicated such that orders can be placed accordingly. Further, when system 210 is placed within infrastructure having automated ordering capability, scheduling operation 228 can provide information to be used in such automated ordering. Still further, in instances, where system 210 is used by an entity that also produces all or some of the materials used in the production 10 of garments 110, the information from scheduling operation 228 can be used in operations 256 associated with material production, including schedule generation or automated production operations. In a similar manner, scheduling operation 228 can consider material production information provided back from material production operation(s) 256 in deriving schedule 230.

It will be understood by one having ordinary skill in the art that construction of the described device and other components is not limited to any specific material. Other exemplary embodiments of the device disclosed herein may be formed from a wide variety of materials, unless described otherwise herein.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which are defined by the following claims as interpreted according to the principles of patent law, including the Doctrine of Equivalents.

The invention claimed is:

1. A method for manufacturing a garment, comprising:

gathering customer data from a plurality of customers, the customer data being associated with respective ones of a plurality of garment orders and including customer information regarding at least one customizable garment parameter;

generating a schedule for producing a plurality of customized garments including analyzing the at least one customizable garment parameter for the at least some of the plurality of garment orders; and manufacturing the plurality of customized garments according to the schedule, wherein the at least one customizable garment parameter for each of the at least some of the plurality of garment orders includes sizing information for a portion of the garment; and generating the schedule for producing the plurality of customized garments includes grouping a predetermined set of the plurality of garment orders according to the sizing information.

2. The method of claim 1, further including generating manufacturing instructions for the plurality of customized garments by a process that includes applying at least one sequencing module to the customer data associated with each of the plurality of garment orders, with the at least one customizable garment parameter as an input thereto.

3. The method of claim 2, wherein the manufacturing instructions are a pattern for a knitted garment with the at least one sequencing module generating a portion of the pattern that comprises a series of stitch transfers executable by an automated knitting machine.

4. The method of claim 1, wherein the customer data is gathered from the plurality of customers over the internet.

5. A method for manufacturing a garment, comprising:

gathering customer data from a plurality of customers, the customer data being associated with respective ones of a plurality of garment orders and including customer information regarding at least one customizable garment parameter;

generating a schedule for producing a plurality of customized garments including analyzing the at least one customizable garment parameter for the at least some of the plurality of garment orders; and manufacturing the plurality of customized garments according to the schedule, wherein generating the schedule is carried out to increase efficiency in manufacturing the plurality of garments according to at least one of:

a similarity of the at least one customizable garment parameter among a subset of the plurality of garment orders;

availability of materials according to at least one material category associated with the at least one customizable garment parameter; and a similarity of the customer data in addition to the at least one customizable garment parameter among a subset of the plurality of garment orders.

6. A method for manufacturing a garment, comprising:

gathering customer data from a plurality of customers, the customer data being associated with respective ones of a plurality of garment orders and including customer information regarding at least one customizable garment parameter;

generating predictive data for a plurality of anticipated orders based at least on historic customer data related to the at least one customizable garment parameter, each of the anticipated orders having associated therewith anticipated data relating to the at least one customizable garment parameter;

generating a schedule for producing a plurality of customized garments including analyzing the at least one customizable garment parameter for the at least some of the plurality of garment orders; and manufacturing the plurality of customized garments according to the schedule, wherein:

the plurality of garment orders further includes the plurality of anticipated orders.

7. The method of claim 6, wherein the schedule for producing the plurality of customized garments is further carried out to at least one of:

minimize a time interval between receiving ones of the plurality of garment orders from respective customers and a step of fulfilling the garment orders from respective customers;

minimize inventory of ones of the plurality of garments derived from the anticipated orders;

manage a capacity of at least one automated knitting machine used in manufacturing the plurality of customized garments;

prioritize use of available materials.

8. The method of claim 6, wherein the predictive data is generated using trend forecasting information based on the archived customer data.

9. A method for manufacturing a garment, comprising:

gathering customer data from a plurality of customers, the customer data being associated with respective ones of a plurality of garment orders and including customer information regarding at least one customizable garment parameter;

generating manufacturing instructions for the plurality of customized garments based on the at least one customizable garment parameter associated with each of the at least some of the plurality of garment orders;

generating a schedule for producing a plurality of customized garments including analyzing the at least one customizable garment parameter for the at least some of the plurality of garment orders; and manufacturing the plurality of customized garments according to the schedule, wherein:

the at least one customizable garment parameter for each of the at least some of the plurality of garment orders includes sizing information for a portion of the garment; and generating the schedule for producing the plurality of customized garments includes grouping a predetermined set of the plurality of garment orders according to the sizing information.

10. The method of claim 9, wherein the manufacturing instructions are generated by a process that includes applying at least one sequencing module to the customer data associated with each of the plurality of garment orders.

11. The method of claim 10, wherein the at least one sequencing module is applied with the at least one customizable garment parameter as an input thereto.

12. The method of claim 10, wherein the manufacturing instructions are a pattern for a knitted garment with the at least one sequencing module generating a portion of the pattern that comprises a series of stitch transfers executable by an automated knitting machine.

13. The method of claim 12, wherein the series of stitch transfers includes:

transferring stitches on respective needles in a first section from a first needle bed to a second needle bed;

transferring stitches on respective needles in a second section from the second needle bed to the first needle bed, the first and second section stitches being divided about a center location and being disposed on corresponding first and second sides thereof;

applying a first transfer sequence to the first section of stitches including executing an underlapping transfer of stitches from successive pairs of needles in the second bed to successive single needles in the first bed, respectively; and applying a second transfer sequence to the second section of stitches including executing an overlapping transfer of stitches from successive pairs of needles in the second bed to successive single needles in the first bed, respectively.

14. The method of claim 12, wherein the at least one sequencing module is a radial symmetry module.

15. A method for manufacturing a garment, comprising:

gathering customer data from a plurality of customers, the customer data being associated with respective ones of a plurality of garment orders and including customer sizing information regarding at least one customizable garment parameter for at least a portion of the garment;

generating a schedule for producing a plurality of customized garments including analyzing the at least one customizable garment parameter for the at least some of the plurality of garment orders; and manufacturing the plurality of customized garments according to the schedule, wherein generating the schedule for producing the plurality of customized garments includes grouping a predetermined set of the plurality of garment orders according to the sizing information.

16. The method of claim 15, wherein:

the sizing information is in the form of measurement data;

generating the schedule for producing the plurality of customized garments further includes determining a plurality of fixed sizes by processing the measurement data over the set of the plurality of garment orders, the plurality of garment orders being distributed among the plurality of fixed sizes; and manufacturing the plurality of garments according to the schedule includes manufacturing of plurality of garments in groups according to the plurality of fixed sizes.

17. The method of claim 15, further including generating manufacturing instructions for the plurality of customized garments based on the sizing information regarding the at least one customizable garment parameter associated with each of the at least some of the plurality of garment orders.

* * * * *